US007950518B2

(12) United States Patent
Fehrenbach et al.

(10) Patent No.: US 7,950,518 B2
(45) Date of Patent: May 31, 2011

(54) APPARATUS FOR ALIGNING VOUCHERS

(75) Inventors: Christian Fehrenbach, Schonach (DE); Ulrich Nottelmann, Bad Driburg (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 12/607,811

(22) Filed: Oct. 28, 2009

(65) Prior Publication Data

US 2010/0126827 A1 May 27, 2010

Related U.S. Application Data

(63) Continuation of application No. PCT/EP2009/062886, filed on Oct. 5, 2009.

(30) Foreign Application Priority Data

Oct. 6, 2008 (DE) ..... 10 2008 050 524

(51) Int. Cl.
*B65G 47/24* (2006.01)

(52) U.S. Cl. ..... 198/411; 198/415

(58) Field of Classification Search ..... 198/400, 198/411, 413, 415, 608, 626.1
See application file for complete search history.

(56) References Cited

U.S. PATENT DOCUMENTS

| | | | | |
|---|---|---|---|---|
| 5,012,915 | A * | 5/1991 | Kristola et al. | 198/411 |
| 5,755,437 | A | 5/1998 | Ek | |
| 5,836,439 | A * | 11/1998 | Coyette | 198/415 |
| 5,860,646 | A * | 1/1999 | Fowler et al. | 198/411 |
| 6,923,309 | B2 * | 8/2005 | Costanzo | 198/411 |
| 2007/0023995 | A1 | 2/2007 | Onodera | |
| 2008/0073824 | A1 | 3/2008 | Watanabe et al. | |
| 2009/0200139 | A1 * | 8/2009 | Kissee et al. | 198/415 |

FOREIGN PATENT DOCUMENTS

| | | | |
|---|---|---|---|
| DE | 2104 113 | A1 | 8/1971 |
| DE | 696 09 227 | T2 | 11/2000 |
| DE | 100 23 290 | A1 | 11/2001 |
| DE | 10 2004 060191 | A1 | 6/2006 |
| DE | 1 0 2007 050 449 | A1 | 3/2009 |
| EP | 0 431 267 | A1 | 6/1991 |
| EP | 1 433 728 | A1 | 6/2004 |
| EP | 1 637 487 | A2 | 3/2006 |
| JP | 59053346 | A | 3/1984 |
| WO | WO-2004/014768 | A1 | 2/2004 |

* cited by examiner

*Primary Examiner* — James R Bidwell
(74) *Attorney, Agent, or Firm* — Harness, Dickey & Pierce, P.L.C.

(57) ABSTRACT

The invention relates to an apparatus for aligning at least one voucher (12 to 18). The apparatus has first and second transport elements (24 to 52, 224 to 252) for transporting the voucher (12 to 18) on a transport plane (10) of a transport path. At least one first rotating transport element (38 to 52, 238 to 252) generates a driving force acting on the voucher (12 to 18) obliquely to the center axis (20) lying on the transport plane (10) of the transport path. At least one second rotating transport element (24 to 36, 224 to 296) generates a driving force acting on the voucher (12 to 18) parallel to the center axis (20). At least one first drive unit (304, 306, 313 to 322*b*) moves the first rotating transport element (38 to 52, 238 to 252) at least to the transport plane (10). At least one second drive unit (304, 306, 313 to 322) moves the second rotating transport element (24 to 36) at least to the transport plane (10). Further, the apparatus comprises a pressure unit (278*a*, 278*b*) that applies a pressure force when in a pressure position to the voucher (12 to 18).

20 Claims, 15 Drawing Sheets

APPARATUS FOR ALIGNING VOUCHERS

BACKGROUND OF THE INVENTION

1. Technical Field

The invention relates to an apparatus for aligning vouchers while they are being transported along a transport path, for example, inside an automated teller machine or an automated safe. Concerning the vouchers specifically, they may be bank notes or checks that are being taken to a cassette for storage for example, or that have been removed from said cassette. The apparatus contains at least one transport element for transporting the voucher along the transport path. The transport element specifically may be configured as a roller, drum or belt.

2. Discussion

In the case of voucher machines, such as automated teller machines, automated safes and automats for issuing gift certificates and tickets, individual vouchers to be input are transported from an input drawer into a storage area, and/or vouchers to be output are transported from a storage area to an output drawer. The storage area can be provided by a transport cassette for storing and transporting the vouchers. In order to achieve a greatest possible throughput when transporting the vouchers and to prevent disruptions as the consequence of the vouchers jamming, known as paper jams, the usually rectangular vouchers are aligned with their longitudinal axis perpendicular to the transport direction. Alignment of this type is also termed long-side-first alignment. The risk of a paper jam is particularly high with used vouchers since such vouchers possess reduced stiffness, and soiling on the surface of the voucher increases. Particularly in the case of such used vouchers, they may be twisted when drawn in or pulled during transportation. Consequently, the vouchers may be displaced laterally and/or be displaced at an angle to a desired, specified position.

An apparatus for aligning vouchers is known from document DE 10 2004 060 191 A1, for example. This apparatus dispenses with lateral guide elements, such as are known for aligning and guiding individual sheets in printers or copiers for example. In the case of vouchers, the use of lateral guide elements would result in a misalignment and/or a disruption as the result of a paper jam because of the variations in stiffness and the different edge quality of vouchers.

SUMMARY OF THE INVENTION

An object of the invention is to cite an apparatus for aligning a voucher by which a lateral displacement and/or angular displacement of the voucher can be corrected in a simple manner while it is being transported along a transport path.

Through the apparatus in accordance with the invention, an angular displacement of the voucher can be corrected by the at least one pressure element, and a driving force can be generated on the voucher by the at least one first rotating transport element acting obliquely to a center axis of the transport path lying in the transport plane. The first rotating transport element is moved at least to the transport plane with the aid of the first drive unit or moved further through said plane. The first rotating transport element is preferably also moved away from the transport plane with the aid of this first drive unit. The movement of the first rotating transport element generated by the drive unit can occur orthogonally to the transport plane, obliquely to the transport plane or along a curved path intersecting the transport plane. With the aid of the at least one pressure unit of the apparatus, a pressure force is exerted on the voucher when the pressure unit is in a pressure position. Preferably the pressure force is exerted on the voucher orthogonally or obliquely to the transport plane.

The apparatus can further comprise at least a second rotating transport element that generates a driving force on the voucher parallel to the center axis or along the center axis. A second drive unit can be provided to move the second rotating transport element to the transport plane, preferably orthogonally or obliquely to the transport plane or on a curved path intersecting the transport plane. The first drive unit and the second drive unit are activated alternately, or in turn, so that either the first rotating transport element in the transport plane applies a driving force to the voucher obliquely to a center axis of the transport path lying in the transport plane, or the second rotating transport element applies a driving force to said voucher parallel to the center axis of the transport path.

The rotating transport elements can specifically be driven and/or non-driven transport elements, preferable non-driven transport rollers.

The transport plane is preferably delimited by several transport elements, at least some of which are disposed one after the other in the transport direction. The transport plane can furthermore be located between a first limit plate and a second limit plate. In particular, the transport elements can be disposed, and the limit plate configured, in such manner that the transport plane has an arched or curved shape in the transport direction.

It is further advantageous if the direction of the first rotating transport element for transporting the voucher in the transport plane obliquely to the center axis of the transport path and the direction of the second rotating transport element run parallel to the center axis of the transport path.

It is particularly advantageous if the first rotating transport element and/or the second rotating transport element comprises at least one roller pair. The roller pair comprises a pressure roller and a drive roller. The pressure roller of the roller pair can be moved perpendicularly to the transport plane with the aid of the first drive unit or the second drive unit. It is advantageous if the apparatus has at least two, preferably eight roller pairs, to correct a lateral displacement of the voucher. Four roller pairs are thereby provided for a movement of the voucher in a first direction and four rollers for a movement in a second direction obliquely to the center axis. A lateral displacement on the part of the voucher to the right and to the left in the transport direction can be generated or corrected. In each instance, the pressure rollers and the drive rollers of two roller pairs have a common axis of rotation, whereby the respective rollers are disposed at a distance on the axis of rotation so that the voucher is contacted by these roller pairs at two points that are spaced apart from one another.

As a result, the driving forces can act on the voucher at suitable points. The axes of rotation of two roller pairs serving as first transport element, disposed behind one another when viewed in the transport direction, preferably have parallel axes of rotation that are preferably disposed in a plane parallel to the transport plane. As a result, transport units respectively comprising two roller pairs are provided to generate a lateral displacement in one direction obliquely in each case to the center axis, i.e. to one lateral edge of the transport path. The transport units are spaced apart from each other in the direction of transport. It is further advantageous to provide a sensor unit to identify a position of the voucher. It is further advantageous in this respect to provide at least one control unit that, starting from the position of the voucher identified by the sensor unit and from a preset specified position, identifies a lateral and/or angular displacement of the voucher and activates the first drive unit and/or the second drive unit to move at least one rotating transport element, and/or activates the pressure unit in such a way that a lateral and/or angular displacement of the voucher is corrected after said voucher is transported along the transport path. The sensor unit can additionally perform a verification of the voucher's genuineness.

Preferably two roller pairs in each case, or two transport units in each case, are disposed mirror-symmetrically to a center plane running orthogonally to the transport plane through the center axis of the transport path in order to correct the lateral displacement. In this way, a lateral displacement can be corrected in two opposite directions. The conveyance directions of the first transport elements to correct a lateral displacement of the voucher, disposed in the transport plane on a first side of a center plane running orthogonally to the transport plane through the center axis of the transport path, preferably have respectively the same first angle to an orthogonal to the transport path lying in the transport plane. The conveyance directions of the roller pairs for correcting a lateral displacement of the voucher, disposed in the transport plane on the opposite, second side of the center plane, preferably have respectively the same second angle to an orthogonal to the center axis of the transport path lying in the transport plane. The first angle and the second angle preferably have the same value and an opposite sign. It is advantageous if the first angle has a value in the range from +20° to +35°, preferably +25°, and if the second angle has a value in the range from −20° to −35°, preferably −25°. At a relatively high transport speed in the transport direction, an adequate lateral displacement can be created or corrected in order to correct normal discrepancies in the position of the voucher in an automated teller machine. Specifically, it is possible as a result to move a voucher by up to 3 cm in each direction in the transport plane perpendicular to the center axis of the transport path in order to correct a lateral displacement of the voucher.

The drive rollers of the roller pairs serving to correct the lateral displacement are located on at least one shaft so that they cannot rotate, wherein one drive unit drives the shaft over at least one belt. Preferably the drive rollers of each two roller pairs are located on a common shaft so that they cannot rotate, said shaft being driven by the drive unit by way of the at least one belt.

The at least one first drive unit for moving the drive rollers of the roller pairs for correcting a lateral displacement of a voucher moves the drive rollers selectively in the direction of the drive rollers and in the opposite direction. Preferably the drive is applied both actively toward the drive rollers as well as actively in the opposite direction, wherein outside energy, preferably electrical energy, is supplied to the first drive unit both for driving toward the drive rollers as well as in the opposite direction. The construction and operation of the second drive unit are preferably identical to the construction and operation of the first drive unit.

The drive unit for moving the drive rollers of the roller pairs for correcting lateral displacement comprises at least one lift solenoid. A lift solenoid of this kind can be specifically designed as a double lift solenoid, is a cost-effective structural element to generate a linear motion, and is relatively small in size. The axes of rotation for the drive rollers in a preferred embodiment are fixed in place. The drive unit shifts the axes of rotation for the pressure rollers during a movement of the pressure rollers obliquely or perpendicular to the transport plane or along a curved path toward the respective pressure roller opposite.

As an alternative to, or in addition to, a roller pair, the second transport element can comprise at least a pair of transport belts. The pair of transport belts comprises a driven transport belt and a non-driven transport belt. At least one area of the non-driven transport belt can be moved, preferably orthogonally or obliquely to the transportation plane. A drive unit to move the non-driven transport belt comprises preferably at least one lift solenoid, preferably at least one double lift solenoid.

In this respect, it is advantageous that at least one drive unit drives the drive rollers of the roller pairs for correcting a lateral displacement and the drive rollers of the roller pairs, or the driven transport belt of the pair of transport belts, for the straight-line transport of the vouchers along, or parallel to, a center axis of the transport path lying in the transport plane, at the same circumferential speed.

In one particularly advantageous embodiment, the apparatus has at least two pressure units. The pressure units are preferably spaced laterally at the same distance from a center plane running orthogonally to the transport plane through the center axis of the transport path, wherein the direction of the pressure forces that can be applied by the pressure units to the voucher run parallel to one another, and preferably parallel to the center axis as well.

The at least one pressure unit has a drive unit that preferably encompasses a lift solenoid that moves a pressure element in the pressure unit toward the transport plane, preferably orthogonally to the transport plane, and thereby preferably applies a force to the voucher orthogonally to the transport plane. It is advantageous in this respect to provide means of counter pressure with fixed counter-pressure surfaces on the side of the transport plane lying opposite to the pressure unit. A voucher can thereby be squeezed with the aid of the pressure unit between the pressure unit and the means of counter pressure, preferably held fast, so that the movement of the voucher in the transport direction at the contact point with the pressure element is at least braked or stopped.

It is furthermore advantageous to configure the circumferential surface of at least one drive roller located behind the pressure unit in the transport direction and/or at least one pressure roller located behind the pressure unit in the transport direction to be rounded. A rotary movement of the voucher in the transportation plane to correct an angular displacement can be facilitated thereby.

In a further advantageous embodiment of the invention, a first delimiting element delimiting a transport area of the transport path is provided having a first contact area facing the transport area, and/or a second delimiting element delimiting a transport area of the transport path is provided having a second contact area facing the transport area. The contact areas are preferably located lying opposite one another and delimit the transport area. At least one contact area has several dome-shaped embossments that project convexly from the contact area. As the result of these projecting embossments, areal contact of the voucher with the contact area is prevented so that the vouchers do not adhere to the contact areas and/or do not become electrostatically charged. The first and/or second contact area, viewed in the transport direction, has a depression behind at least one drive and/or pressure roller. The depression is configured such that a conveying movement of the voucher, running obliquely to the center axis to correct the lateral displacement, is not hampered by the lateral shoulders created by the depression. Specifically, the depression is shaped such that a lateral edge of the voucher cannot catch on a lateral shoulder of the depression.

When a lateral displacement or an angular displacement of the voucher relative to a target position for the voucher has been identified with the aid of a sensor unit, a control unit can activate the at least one first drive unit and/or the at least one second drive unit to move the at least one rotating first and/or second transport element at least to the transport plane in such a way that the lateral and/or angular displacement of the voucher that has been identified can be corrected.

The control unit determines, based on the lateral displacement identified, in which time period at least one pressure roller of a roller pair is pressed against the drive rollers lying opposite the pressure roller as the voucher is transported along the transport path, wherein, with several pressure rollers, different pressure periods can be determined. Furthermore, the control unit can, based on the angular displacement, determine for which time period at least one of the pressure units applies a pressure force to this voucher as the voucher is transported along the transport path, wherein, with several pressure units, different pressure periods can be determined.

It is particularly advantageous if the contact area of the pressure elements in the pressure units that contacts the vouchers has an element made of rubber, or a coating for the contact area of rubber, or another material with high coefficients of friction. It is further advantageous if the end of the pressure units facing in the direction of the transport plane is hemispherical in shape so that the pressure force is introduced into the voucher in a punctiform manner, or over a small area. It is further advantageous if the cover plate of the lower part at the locations where the pressure elements press against the cover plate of the lower part has hemispherical elevations in the direction of the transportation plane to prevent the vouchers from adhering to the cover plate.

The voucher may be specifically a bank note, a check, a gift certificate or a ticket.

BRIEF DESCRIPTION OF THE DRAWINGS

Additional features and advantages of the invention become apparent from the following description, which, in conjunction with the appended figures, explains the invention in greater detail.

DESCRIPTION OF THE PREFERRED EMBODIMENTS

Figure 1:
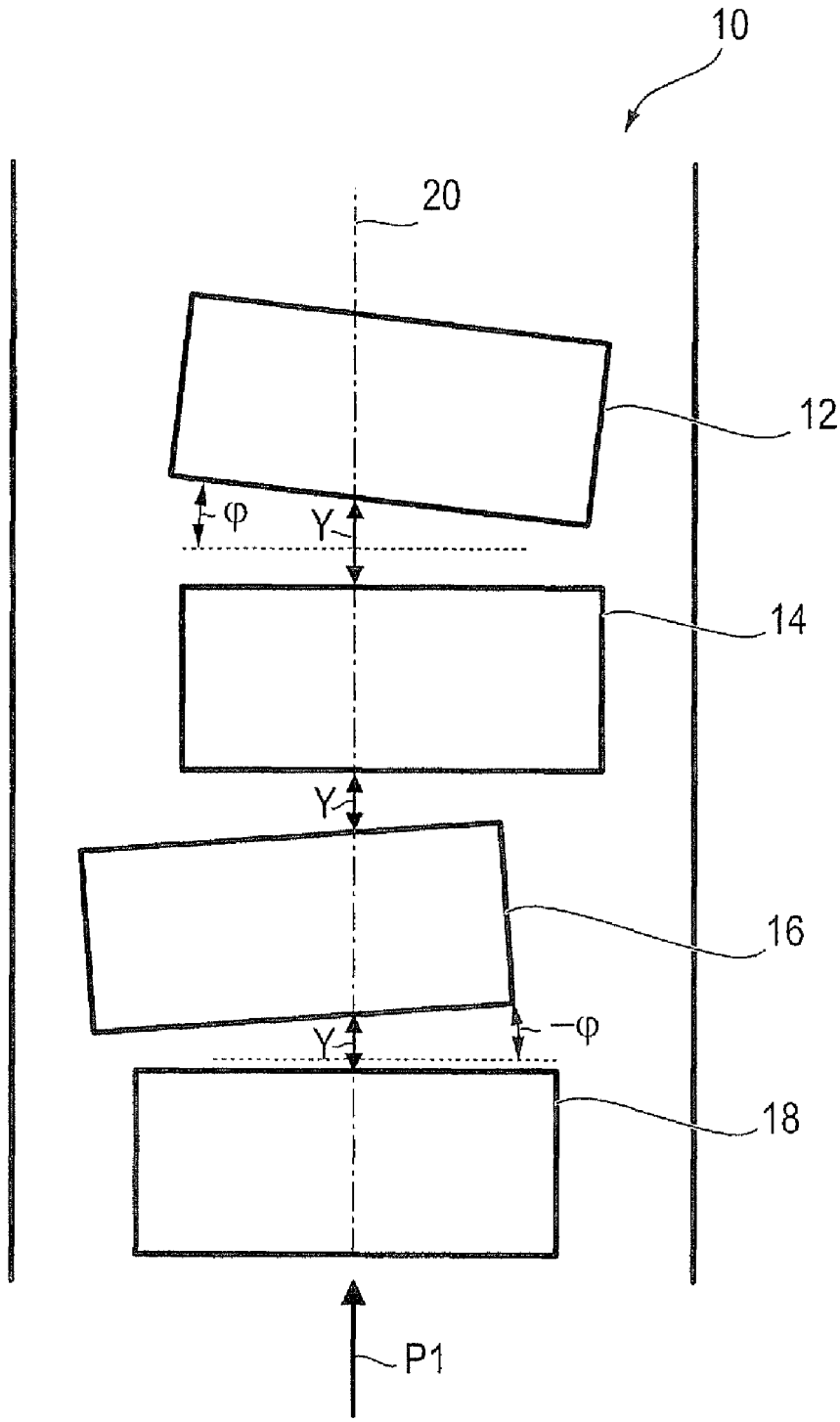
FIG. 1 shows a schematic representation of several vouchers transported along a transport path.

FIG. 1 shows a schematic representation of several vouchers 12 to 18 disposed along a transport plane 10 in accordance with an embodiment of the invention. The vouchers 12 to 18 are transported with the aid of transport means not shown, such as rollers, drums, belts and/or diverters. The dot-dash line 20 indicates the center axis of the transport path 10. Vouchers 12 to 18 are transported on a transport plane formed by the transport path 10. In what follows, a transport plane of this type will also be designated with the reference numeral 10.

Vouchers 12 to 18 should occupy a specified position relative to the transport path. The positions of vouchers 12 to 18 should deviate from this specified position only within narrow tolerances. In the specified position, the long sides of voucher 12 to 18 are aligned orthogonally to the transport direction P1, and the short center axis of the voucher 12 to 18 lies on the center axis 20 of transport path 10. Only voucher 18 of vouchers 12 to 18 shown in FIG. 1 is located in the specified position. The long sides of vouchers 12 to 18 are aligned in the present embodiment, at least in the specified position, essentially perpendicular to the transportation direction P1. An alignment of the long sides of the vouchers 12 to 18 of this kind orthogonal to the transport direction P1 is also described as long-side-first (LSF) alignment. Furthermore, it is advantageous if two successive vouchers 12 to 18 are the same distance Y apart in each case. An alignment of vouchers 12 to 18 in the specified position is particularly important when vouchers 12 to 18 are transported at high speed along transport path 10 of an automated teller machine or an automated safe. To align vouchers 12 to 16, the position of which deviates from the specified position, an apparatus for aligning said vouchers 12 to 16 is provided in accordance with the invention. The construction and the operation of the apparatus for aligning vouchers 12 to 18 will be described hereinafter in greater detail in conjunction with the FIGS. 2 to 15. Vouchers 12 to 18 pass through the apparatus at the same transport speed as when they are transported along other transport paths 10 in the automated teller machine or in the automated cash register system. With the aid of a voucher inspection unit not shown for verifying the genuineness of vouchers 12 to 18, the deviation of the vouchers 12 to 18 from their specified position is identified in the present embodiment. The voucher verification unit is located in the transport direction upstream from the apparatus for aligning the vouchers 12 to 18.

Deviations of the position of vouchers 12 to 18 from the specified position can occur particularly when vouchers 12 to 18 are removed from voucher cassettes, with badly bundled vouchers 12 to 18, when vouchers 12 to 18 are input incorrectly by a customer and/or when vouchers 12 to 18 are skewed when being drawn in, or when being transported along transport path 10. When such deviations occur, it is necessary for the vouchers 12 to 18 to be brought into their specified position with the aid of the apparatus for aligning vouchers 12 to 18.

Furthermore, by aligning the vouchers 12 to 18 in their specified position, the alignment of the vouchers 12 to 18 is improved when being stacked to output the vouchers 12 to 18 as a bundle or for depositing vouchers 12 to 18 as a stack, for example in a voucher cassette. In this way, vouchers 12 to 18 can be deposited in a space-saving manner. In addition, vouchers 12 to 18 can be dispensed attractively and conveniently to a customer as an orderly bundle.

The voucher 14 shown in FIG. 1 is not in the specified position. Its long sides are certainly aligned perpendicular to the transportation direction P1, but its short center axis does not lie on the center axis 20 of transport path 10. The short center axis of voucher 14 is displaced to the right so that voucher 14 is not displaced at an angle but is displaced laterally. Voucher 14 must consequently be shifted to the left until the short center axis of voucher 14 lies on the center axis 20 of transport plane 10 in order to bring voucher 14 into its specified position.

Voucher 12 is displaced laterally about the same amount perpendicular to the center axis 20 of the transport path 10 as voucher 14. However, voucher 12 is additionally twisted by an angle $\phi$ to an orthogonal to the center axis of transport path 10. A deviation of this kind by an angle from the specified position is also described as angular displacement. Voucher 12 must be rotated with the aid of the apparatus for aligning vouchers 12 to 18 by the angle $-\phi$ and in addition shifted to the left when viewed in transport direction P1 until the short center axis of voucher 12 lies on center axis 20 of transport path 10 in order to bring voucher 12 into the specified position.

Voucher 16 is displaced at angle of $-\phi$ and is laterally displaced perpendicular to the transport path 10 viewed in transport direction P1. In order to bring this voucher 16 into the specified position, it must be rotated by the angle $\phi$ and shifted to the right until the short center axis of voucher 16 lies on center axis 20 of transport path 10.

Figure 2:
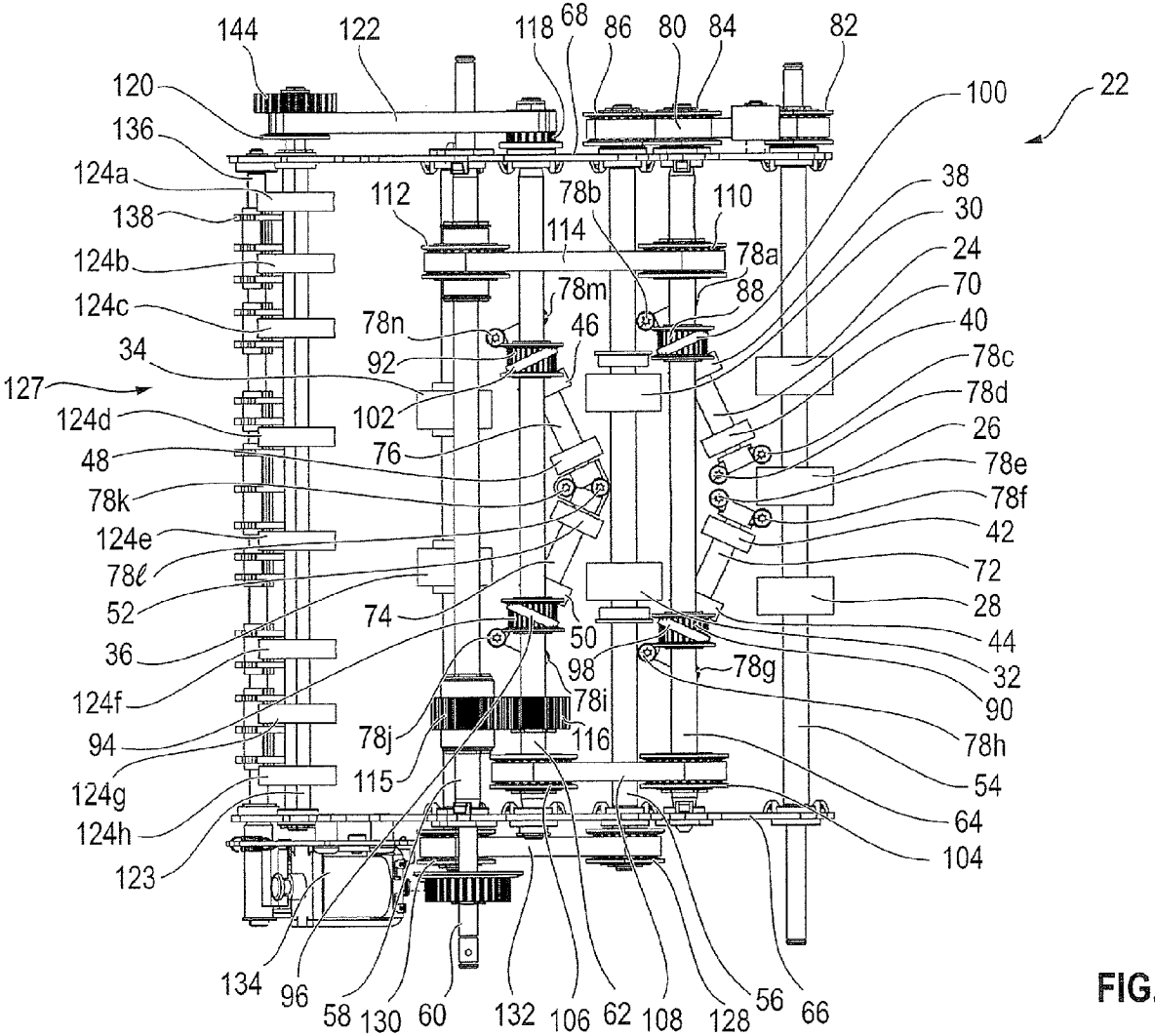
FIG. 2 shows a view from below of a schematic representation of a lower part of an apparatus for aligning vouchers in accordance with a first embodiment of the invention.

FIG. 2 shows a view from below of a schematic representation of a lower part 22 of the invention already mentioned for aligning vouchers 12 to 18. In the present embodiment, the apparatus for aligning vouchers 12 to 18 is installed horizontally in an automated teller machine so that the section of transport path 10 presented by the apparatus is aligned horizontally. In other embodiments, the section of the transport path 10 provided by the apparatus may have a different alignment, specifically, the section of transport path 10 provided by the apparatus can be aligned vertically. Any other installed position is also possible. Elements with the same construction or the same function have the same reference numerals.

The lower part 22 shown in FIG. 2 comprises a total of 15 drive rollers 24 to 52. The rotational direction of drive rollers 24 to 36 causes vouchers 12 to 18 to be transported in transport direction P1 parallel to, or along, the center axis 20. Drive rollers 24 to 28 are disposed on a first drive shaft 54, secured against rotation, fixed in place and not pivotable. Drive roller 26 is disposed on first drive shaft 54 in such a way that center axis 20 of transport plane 10 lies in the radial center plane of drive roller 26. Drive rollers 24 and 28 are disposed mirror-symmetrical to a plane that is located orthogonally to transport plane 10 and which contains center axis 20. Drive rollers 24 and 28 are respectively the same distance from drive roller 26.

Drive rollers 30 and 32 are disposed on a second drive shaft 56, secured against rotation, fixed in place and not pivotable. Drive rollers 30 and 32 are the same distance laterally from center axis 20 of transport plane 10. Drive rollers 34 and 36 are disposed on a third drive shaft 58, secured against rotation, fixed in place and not pivotable, where drive rollers 34 and 36 are similarly disposed on drive shaft 58 mirror-symmetrical to a plane that is located orthogonally to transport plane 10 and on which center axis 20 lies. The spacing of drive rollers 34 and 36 from each other is less than the spacing of drive rollers 30 and 32 from each other. The spacing of drive rollers 30 and 32 from each other is in turn less than the spacing of drive rollers 24 and 28 from each other. Thus, the spacing of the outer drive rollers in transport direction P1 of vouchers 12 to 18 in the apparatus for aligning vouchers 12 to 18 decreases in a downstream direction.

Drive rollers 38 and 40 are connected to a fourth drive shaft 70, drive rollers 42 and 44 to a fifth drive shaft 72, drive rollers 50 and 52 to a sixth drive shaft 74, and drive rollers 46 and 48 to a seventh drive shaft 76, in each case fixed in place, secured against rotation and not pivotable. Drive rollers 38 and 40, drive rollers 42 and 44, drive rollers 46 and 48 and drive rollers 50 and 52 are spaced apart the same distance from each other.

Drive shafts 54 to 58 are located orthogonally to transport direction P1 and thus orthogonally to the center axis 20 of the transport plane 10. Drive shafts 70 to 76, on the other hand, have an angle different from zero to an orthogonal to the center axis 20 of the transport plane 10. Drive shafts 70, 72, 74 and 76 each have the same angle to an orthogonal to the center axis 20. The center axis 20 divides the transport plane 10 into two partial planes. Drive shafts 70 and 76 located in one of these partial planes preferably have the same angle to an orthogonal to a center axis 20 of the transport plane 10. Similarly, drive shafts 72 and 74 located in the other partial plane have the same angle to an orthogonal to the center axis 20 of the transport plane 10. Drive shafts 70 and 72, as well as drive shafts 74 and 76, are located mirror-symmetrical to the center axis 20 of the transport plane 20. Thus, drive rollers 38 and 44, 40 and 42, 46 and 50, 48 and 52 are located in each case mirror-symmetrical to the center axis 20 of the transport plane 10. Preferably the angle of drive shafts 70 and 72 and the angle of drive shafts 74, 76 to a respective orthogonal to the center axis 20 of the transport plane 10 are equal, but with an opposite sign. It is further advantageous if this angle of drive shafts 70 to 76 is +25° or −25°. It is similarly advantageous if the distance of drive roller 40 from drive roller 42 is less than the distance of drive roller 48 from drive roller 52.

The lower part 22 further encompasses three additional drive shafts, specifically an eighth drive shaft 60, a ninth drive shaft 62, and a tenth drive shaft 64. These drive shafts 60 to 64 are also located orthogonally to transport direction P1 and parallel to transport plane 10. Both drive shafts 54 to 58, as well as drive shafts 60 to 64, are carried free to rotate in a first side part 66 and a second side part 68 lying opposite to the first side part 66. The side parts 66 and 68 are located parallel to each other and orthogonally to the transport plane 10. The side parts 66 and 68 are preferably spaced equally from the center axis 20 of the transport plane 10.

In the direction of the side of the second side part 68 facing away from the first side part 66, a first sprocket 82 is located on first drive shaft 54, a second sprocket 84 is located on tenth drive shaft 64, and a third sprocket 86 is located on second drive shaft 56. Sprockets 82 to 86 are connected to drive shafts 54, 64 and 56 secured against rotation and fixed in place. A first cog belt 80 is taken over sprockets 82 to 86. The first cog belt 80 is further taken over a jockey pulley 126. Jockey pulley 126 is attached by way of a shaft not shown in the second side part and carried free to rotate on this shaft. Jockey pulley 126 is located on the side of the second side part 68 facing away from the first side part 66.

Four additional sprockets 110, 104, 88, 90 are further located on the tenth drive shaft 64, secured against rotation and fixed in place. Sprockets 88 and 90 are located mirror-symmetrical to the center axis 20 of the transport plane 10. Three additional sprockets 92, 94, 116 are located on the ninth drive shaft 62. Sprockets 92, 94, 116 are connected to the ninth drive shaft 62 secured against rotation and fixed in place. Sprockets 92 and 94 are in turn located mirror-symmetrical to the center axis 20 of the transport plane 10. Furthermore, two additional sprockets 112 and 115 are located on the eighth drive shaft 60 and connected to the eighth drive shaft 60 secured against rotation and fixed in place. A cog belt 114 is taken over sprocket 110 located on the tenth drive shaft 64 and sprocket 112 located on the eighth drive shaft 60. Further, a cog belt 108 is taken over sprocket 104 that is located on the tenth drive shaft 64 and sprocket 106 located on the ninth drive shaft 62. The sprocket 115 on the eighth drive shaft 60 meshes with the sprocket 116 on the ninth drive shaft 62.

On the side of the first side part 66 facing away from the second side part 68, a sprocket 128 is located on the second drive shaft 56 and a sprocket 130 is located on the third drive shaft 58. Sprocket 128 is connected to the second drive shaft 56, secured against rotation and fixed in place, and sprocket 130 is connected to the third drive shaft 58, secured against rotation and fixed in place. A cog belt 132 is taken over sprockets 128 and 130.

Lower part 22 further encompasses a continuing transport unit 127. This continuing transport unit 127 comprises an eleventh drive shaft 123 on which a total of eight rollers 124*a* to 124*h* are disposed. Rollers 124*a* to 124*h* are connected to the eleventh drive shaft 123, secured against rotation and fixed in place. The eleventh drive shaft 123 is carried free to rotate in the side parts 66 and 68. A small sprocket 120 and a large sprocket 144 are located on the eleventh drive shaft on the side of the second side part facing away from the first side part 66. A small sprocket is also located on the ninth drive shaft 62 on the side of the second side part 68 facing away from the first side part 66 and connected to the ninth drive shaft 62, secured against rotation. A cog belt 122 is taken over the small sprockets 120 and 118. The cog belt 122 is taken over a jockey pulley 140, in addition to the small sprockets 120 and 118. The jockey pulley 140 is concealed in FIG. 2 by the cog belt 122. The exact location of the jockey pulley 140 can be seen from FIG. 4.

The continuing transport unit 127 further comprises a diverter having a shaft 126, on which a total of 17 pivotable guide elements are disposed, secured against rotation, that can be pivoted via the shaft. An example of a guide element is indicated with the reference numeral 138. The shaft 136 can be rotated and the guide elements 138 pivoted by way of a lift solenoid 134 and a lever.

The fourth drive shaft 70 is connected to sprocket 88 by a cog belt 100. The fifth drive shaft 72 is further connected through a cog belt 102 to the sprocket 92 and the sixth drive shaft 74 through a cog belt 96 to the sprocket 94. Drive shafts 70 to 76 are mounted free to rotate on a cover plate not shown in FIG. 2. The cover plate is identified in the remaining figures with the reference numeral 146. Drive shafts 70 to 76 are carried on the frame by way of bearing blocks that are connected by suitable bolts 78*a* to 78*m* to the cover plate 146.

All drive shafts 54 to 64, 70 to 76, 123 are in engagement with each other by way of sprockets 80 to 86, 88 to 94, 104, 106, 110, 112, 114, 118, 120, 128 and 130 so that when one of the drive shafts 54 to 64, 70 to 76, 123 is driven, all drive shafts 54 to 64, 70 to 76, 123 are respectively rotated or driven. It is advantageous to dimension the sprockets in such a way that all spindles 54 to 64, 70 to 76, 123 are driven at the same speed. As a result, the circumferential speed of drive rollers 24 to 36 and drive rollers 38 to 52, with the same roller diameter for drive rollers 24 to 36, 38 to 52, is equal. This can prevent major force in transport direction P1 being applied to vouchers 12 to 18, as the result of which vouchers 12 to 18 might be damaged. Furthermore, vouchers 12 to 18 might collide with each other in transport direction P1 as the result of different circumferential speeds, which might result in what is called a paper jam. The drive for one or more drive shafts 54 to 64; 70 to 76; 123 can be provided by one or more electric motors not shown.

Figure 3:
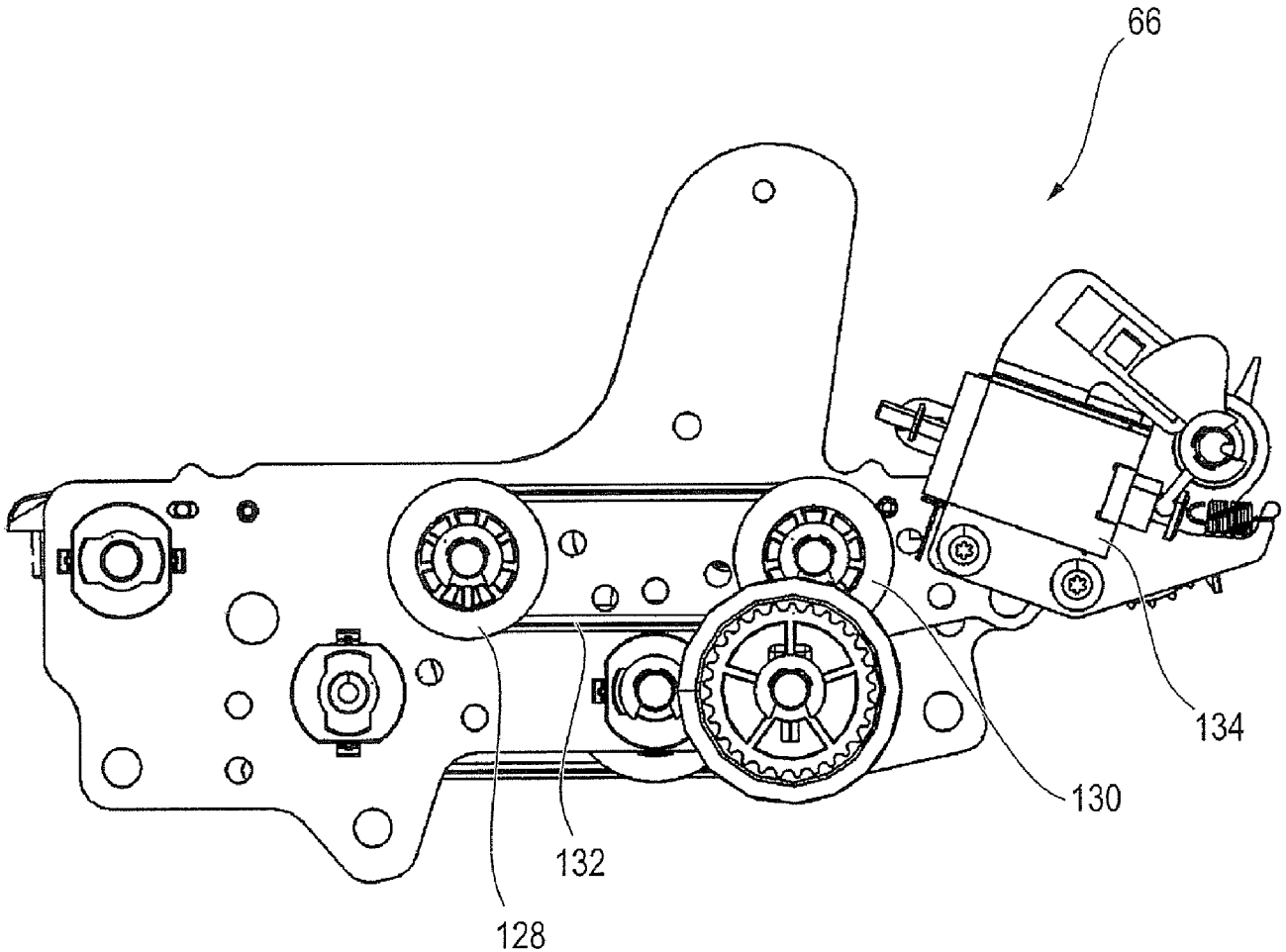
FIG. 3 shows a side elevation of the lower part of FIG. 2 with a view of a first side part.

FIG. 3 shows a side elevation of lower part 22 from FIG. 2 with a view of the first side part 66.

Figure 4:
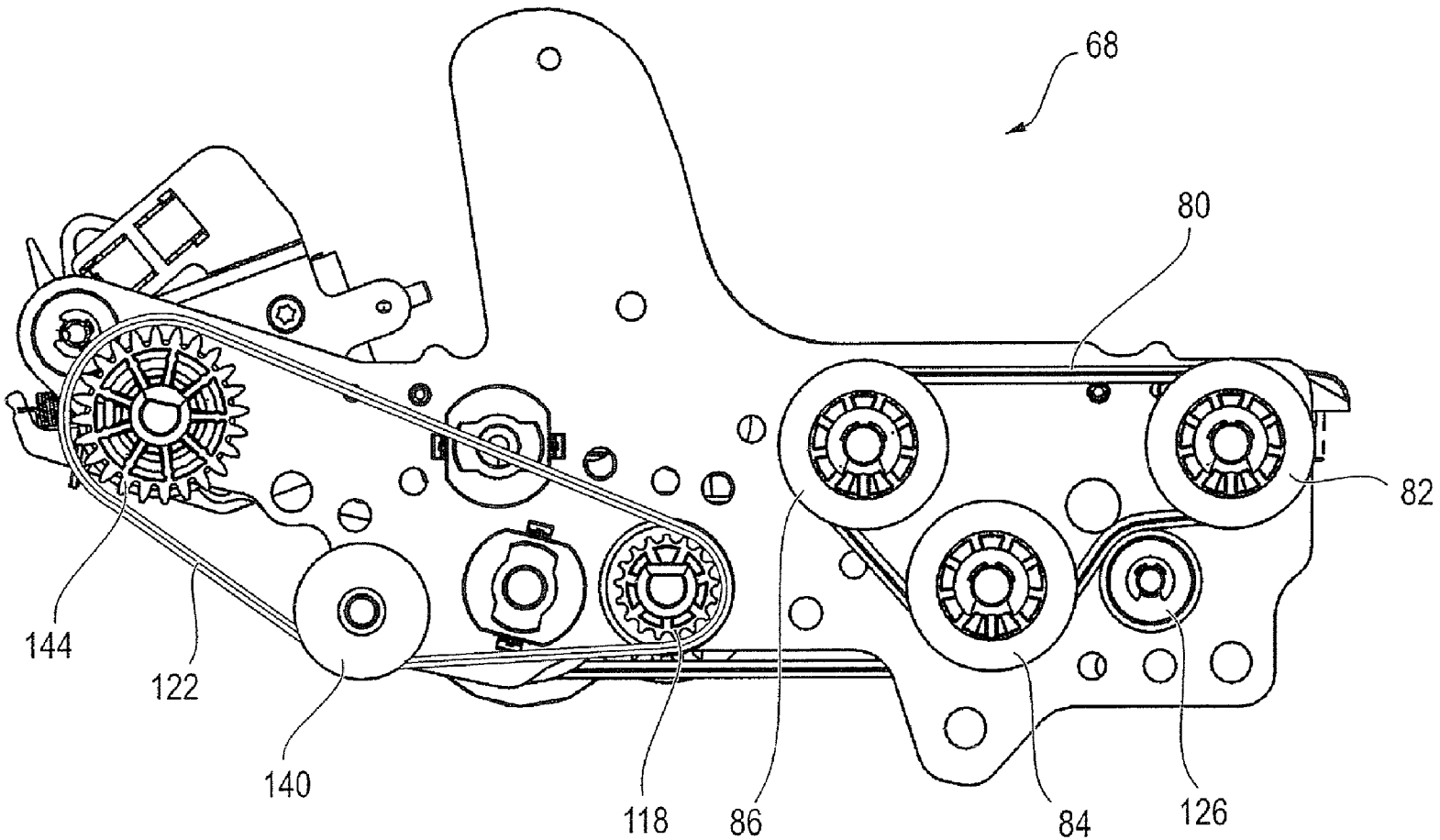
FIG. 4 shows a further side elevation of the lower part of FIGS. 2 and 3 of the side lying opposite the side shown in FIG. 3.

FIG. 4 shows a side elevation of lower part 22 from FIGS. 2 and 3 with a view of second side part 68. Cog belt 122 is taken over sprockets 118 and 120 and additionally over jockey pulley 140. Jockey pulley 140 is connected free to rotate to the second side part 68 by way of a shaft. The jockey pulley is located on the side of the second side part 68 facing away from first side part 66.

Figure 5:
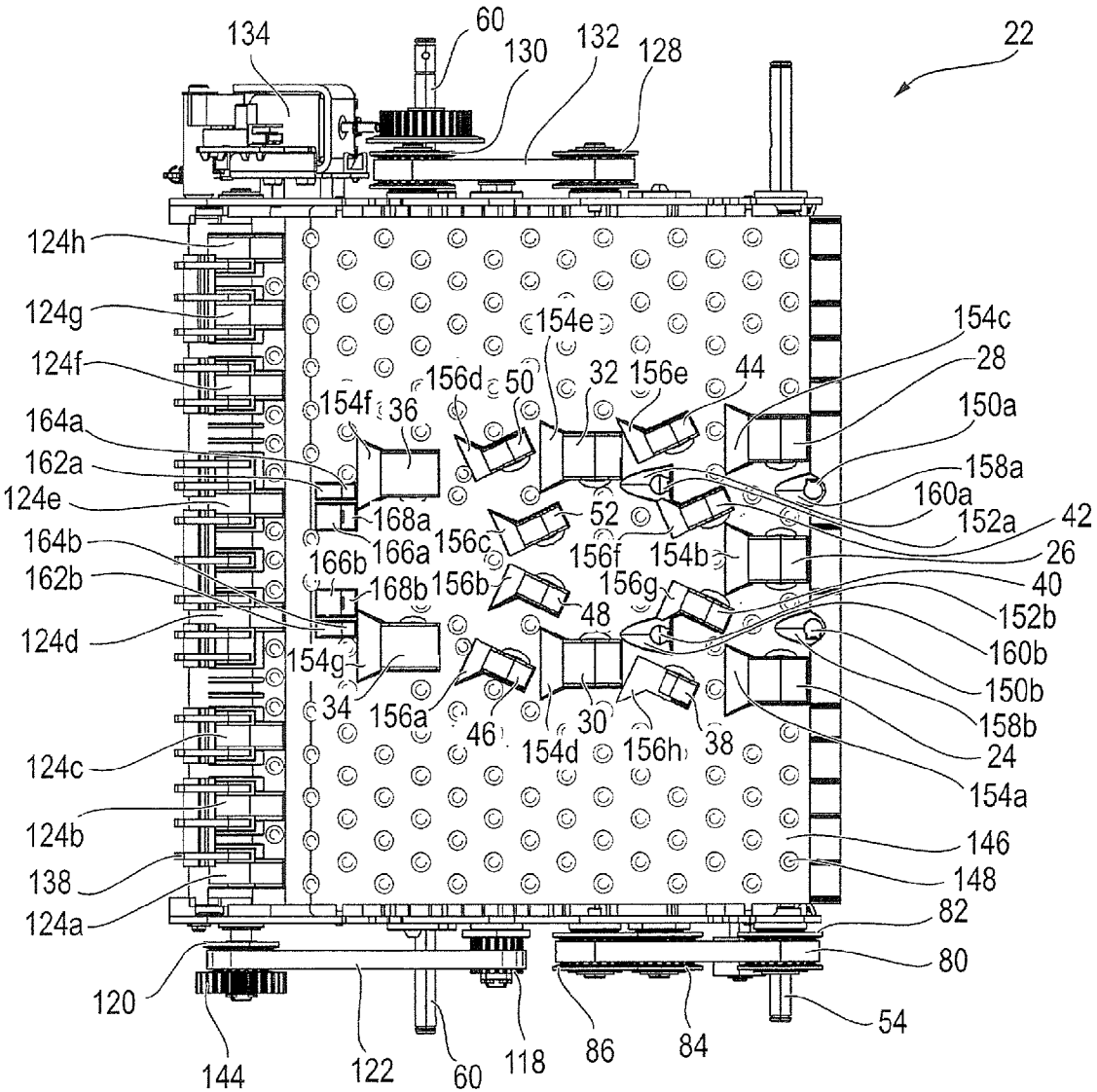
FIG. 5 shows a plan view of the lower part of FIGS. 2 to 4.

FIG. 5 is a plan view of lower part 22 from FIGS. 2 to 4. Lower part 22 has a cover plate 146 that additionally delimits transport path 10. Several dome-like embossments are located on the surface of cover plate 146, which faces in the direction of transport plane 10, that project convexly from the cover plate 146 similarly in the direction of transport plane 10. An example of one of these dome-like embossments is identified with the reference numeral 148. Dome-like embossments 148 on the surface of cover plate 146 reduce the friction of vouchers 12 to 18 against the cover plate and electrostatic charging of vouchers 12 to 18 caused by the friction. Embossments 148 prevent vouchers 12 to 18 from adhering to cover plate 146. The effect of this, in turn, is that vouchers 12 to 18 can be transported without hindrance and vouchers 12 to 18 can be aligned with the aid of the apparatus in accordance with the invention without disruption.

Cover plate 146 is dimensioned such that it covers the entire area between the two side parts 66 and 68. Cover plate 146 has recesses through which driver rollers 24 to 52 project through the cover plate 146 and protrude from said plate. Driver rollers 24 to 52 preferably project further into transport path 10 than dome-shaped protuberances 148. The circumferential surfaces of drive rollers 24 to 52 preferably contact transport path 10 so drive rollers 24 to 52 contact vouchers 12 to 18 as they are transported through the apparatus.

Cover plate 146, when viewed in transport direction P1 of vouchers 12 to 18, has a wedge-shaped depression 154*a* to 154*g* behind each drive roller 24 to 36. Depressions 154*a* to 154*g* have their respective lowest point, when viewed in transport direction P1, behind respective drive rollers 24 to 36 and rise steadily to the level of cover plate 146. The width of depressions 154*a* to 154*g* increases in linear fashion in transport direction P1. Cover plate 146 similarly has a depression 156*a* to 156*h* behind each drive roller 38 to 52. Depressions 156*a* to 156*h* also have their lowest point immediately behind drive rollers 38 to 52, viewed in transport direction P1. The depth of depressions 156*a* to 156*h* increases in linear fashion up to the level of cover plate 146. While the width of depressions 154*a* to 154*g* increases steadily in both directions, the width of depression 156*a* to 156*h* increases in only one direction, that is to say on the side facing away from the center plane. Depressions 154*a* to 154*g* and depressions 156*a* to 156*h* function to not prevent a lateral movement of vouchers 12 to 18 when correcting a lateral displacement, so that said recesses specifically do not form a lateral stop for vouchers 12 to 18 transported obliquely to transport direction P1.

Cover plate 146 further has four additional depressions 158*a*, 158*b*, 160*a*, 160*b*. At least one sensor element 150*a*, 150*b*, 152*a*, 152*b* is located respectively in these depressions. For example, light sources and photoelectric receivers are used as sensor elements 150*a*, 150*b*, 152*a*, 152*b*. Sensor elements 150*a*, 150*b*, 152*a*, 152*b*, located at the beginning of the transport path when viewed in transport direction P1, serve to identify the location and position of vouchers 12 to 18 when they pass the apparatus for aligning vouchers 12 to 18. Preferably, sensor elements complementary to sensor elements 150*a*, 150*b*, 152*a*, 152*b* are oppositely located in an upper part lying opposite lower part 22, as will be explained in more detail hereinafter. The signals generated by sensors 150*a*, 150*b* are evaluated in an analysis unit not shown, and a possible lateral displacement, or an existing lateral and/or angular displacement, and/or a paper jam of vouchers 12 to 18 brought in is identified, and/or voucher tracking is carried out.

On the basis of an identified present lateral and/or angular displacement of vouchers 12 to 18, drive units for alignment elements in the apparatus shown for aligning vouchers 12 to 18, which will be explained in greater detail hereinafter, can be activated. With the aid of sensor elements 152*a*, 152*b*, a check can be made whether a necessary reduction or elimination of the positional and/or angular displacement as far as the location of sensor elements 152*a*, 152*b* has taken place as expected. In the event of any deviations, the activation of the following aligning elements, downstream from sensor elements 152*a*, 152*b* when viewed in transport direction P1, can be modified accordingly to reduce or eliminate a possible angular and/or lateral displacement of vouchers 12 to 18.

Cover plate 146 has two additional recesses 162*a*, 162*b* that are located downstream from drive rollers 36, 34 when viewed in transport direction P1. At least one sensor element 164*a*, 164*b* is located in recesses 162*a*, 162*b*. Sensor elements 164*a*, 164*b* also serve to identify the location and position of vouchers 12 to 18, to identify a paper jam, and to track vouchers 12 to 18. With the aid of the signals generated by sensor elements 164*a* and 164*b* or by additional sensor elements not shown, it can be ascertained whether vouchers 12 to 18 are in the required specified position after passing through the apparatus for aligning vouchers 12 to 18. If a discrepancy between the ascertained position of a voucher 12 to 18 and the desired specified position continues to exist, voucher 12 to 18 can, depending on the design of the apparatus for aligning vouchers 12 to 18, be transported by way of appropriate transport paths (not shown) and re-introduced to the apparatus for aligning vouchers 12 to 18. Consequently, these vouchers 12 to 18 can pass through the apparatus for aligning vouchers 12 to 18 again, for the purpose of reaching the desired specified position in a second pass. This process can be repeated for as many times as necessary until voucher 12 to 18 has reached the required specified position.

Cover plate 146 has in addition two further recesses 166*a*, 166*b*. Recess 158*a*, recess 158*b*, recess 160*a* and recess 160*b*, and recess 162*a*, recess 162*b* and recess 166*a* and recess 166*b* are respectively located mirror-symmetrical to center axis 20 of transport plane 10.

Figure 6:
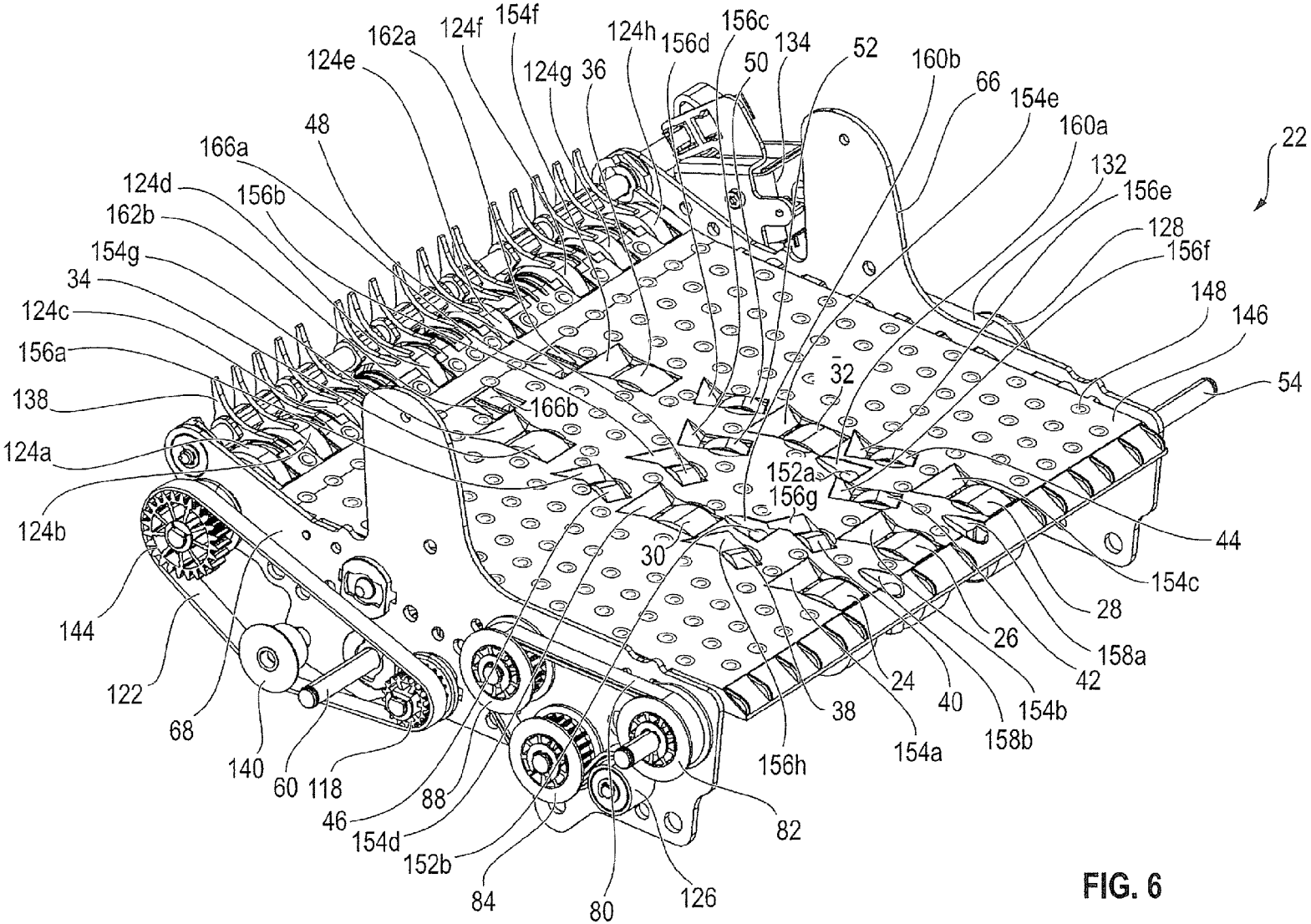
FIG. 6 shows a perspective view of the lower part of FIGS. 2 to 5.

FIG. 6 shows a schematic perspective representation of lower part 22 from FIGS. 2 to 5.

Figure 7:
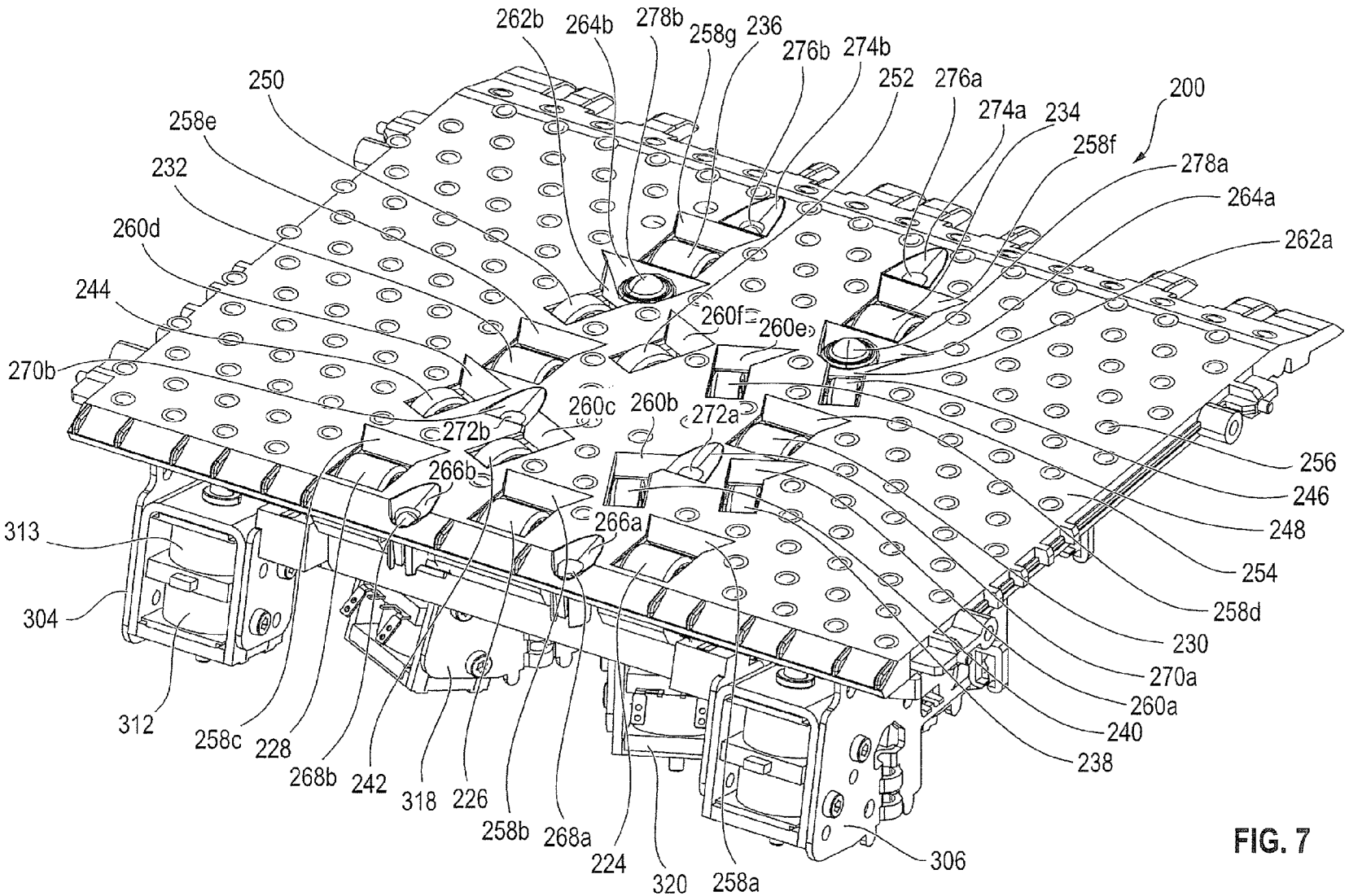
FIG. 7 shows a schematic perspective representation in a plan view of an upper part of the apparatus for aligning vouchers, or a view from below with reference to the installed position of the upper part.

FIG. 7 shows a schematic perspective representation of an upper part 200 of the device for aligning vouchers 12 to 18, with a view of the underside of the upper part 200 with reference to the installed position selected in the embodiment. Upper part 200 comprises a total of 15 pressure rollers 224 to 252. Pressure rollers 224 to 252 are located in upper part 200 in such a way that, when lower part 22 and upper part 200 are correctly installed in an automated teller machine or in an automated safe, one pressure roller 224 to 252 is located opposite a respective drive roller 24 to 52 located in lower part 22 and projecting from cover plate 146 of lower part 22. Preferably one pressure roller 224 to 252 is located exactly opposite a respective pressure roller 22 to 52. It is further advantageous if the respective oppositely located drive roller 24 to 52 is dimensioned identically to pressure roller 224 to 252. The pressure rollers 224 to 252 are not driven and therefore rotate only when they are pressed onto the respective oppositely located drive roller 24 to 52, or onto a voucher 12 to 18 located between the respective pressure roller 224 to 252 and the drive roller 24 to 52 lying opposite said pressure roller. A drive roller 24 to 52 and the respective oppositely located pressure roller 224 to 252 are also described as a roller pair. In the embodiment, therefore, drive roller 24 and pressure roller 224, drive roller 26 and pressure roller 226, drive roller 28 and pressure roller 228, drive roller 30 and pressure roller 230, drive roller 32 and pressure roller 232, drive roller 36 and pressure roller 236, drive roller 38 and pressure roller 238, drive roller 40 and pressure roller 240, drive roller 42 and pressure roller 242, drive roller 44 and pressure roller 244, drive roller 46 and pressure roller 246, drive roller 48 and pressure roller 248, drive roller 52 and pressure roller 252 respectively form a roller pair.

Upper part 200 additionally has a cover plate 252. Cover plate 254 has several dome-shaped embossments 256 that project concavely from cover plate 254 in the direction of transport plane 10. In the same way as the dome-shaped embossments 148 of cover plate 146 of lower part 22, the dome-shaped embossments 256 of cover plate 254 of upper part 200 also serve to reduce the friction between vouchers 12 to 18 and cover plate 254 as vouchers 12 to 18 are being transported in transport direction P1. In the same way as cover plate 146, cover plate 254 has corresponding recesses at the points for pressure rollers 224 to 252. Cover plate 254, when viewed in transport direction P1, further has respective recesses 258*a* to 258*g*, 260*a* to 260*f*, 262*a*, 262*b* behind pressure rollers 224 to 252. Recesses 258*a* to 258*g*, 260*a* to 260*f*, 262*a*, 262*b* provided behind pressure rollers 224 to 252 have respectively a shape mirrored in transport plane 10, like the oppositely located recesses 154*a* to 154*g*, 156*a* to 156*h* in cover plate 146 of lower part 22 that are located behind the respective drive roller 24 to 52 lying opposite the pressure roller 224 to 252.

Furthermore, cover plate 254 of upper part 200 has eight additional recesses 266*a*, 266*b*, 270*a*, 270*b*, 264*a*, 264*b*, 274*a* and 274*b*. At least one sensor element 268*a*, 268*b* is located respectively in recesses 266*a*, 266*b*. Sensor elements 268*a*, 268*b*, together with sensor elements 150*a*, 150*b*, 152*a*, 152*b*, 164*a*, 164*b*, serve to identify the location and position of vouchers 12 to 18, specifically to identify a paper jam or to track vouchers 12 to 18 as they are being transported through the apparatus for aligning vouchers 12 to 18. With the aid of signals generated by sensor elements 150*a*, 150*b*, 268*a*, 268*b*, a possible angular and/or lateral displacement of vouchers 12 to 18 can also be identified with the aid of an evaluation unit not shown. Optical sensor elements are preferably used as sensor elements 150*a*, 150*b*, 268*a*, 268*b*.

Two additional sensor elements 272*a*, 272*b* are similarly located in recesses 270*a*, 270*b*. With the aid of these sensors 272*a*, 272*b* and sensor elements 152*a*, 152*b*, the location and position of vouchers 12 to 18 can be ascertained after they have passed through the first alignment area of the apparatus for aligning vouchers 12 to 18, and/or vouchers 12 to 18 can be tracked. In this way, a check can be made whether the desired reduction or elimination of the angular and/or lateral displacement was successful, and whether vouchers 12 to 18 have been transported correctly along transport path 10. A newly identified angular and/or lateral displacement of vouchers 12 to 18 can be taken into account as necessary when activating the subsequent alignment elements, viewed in transport direction P1, to align vouchers 12 to 18.

Two additional sensor elements 276*a*, 276*b* are located in further recesses 274*a*, 274*b* of cover plate 254. With the aid of sensor elements 276*a*, 276*b* and sensor elements 164*a*, 164*b* located in lower part 22, the location and position of vouchers 12 to 18 can be ascertained after they have passed through the apparatus for aligning vouchers 12 to 18, and tracking of vouchers 12 to 18 has been completed. It can be further determined with the aid of the evaluation unit whether vouchers 12 to 18 are in the specified position or whether an angular and/or lateral displacement still exists. If a voucher 12 to 18 should still have an angular or lateral displacement, the voucher 12 to 18 can, as already described, be returned to the apparatus for aligning vouchers 12 to 18 by way of appropriate transport paths so that said vouchers 12 to 18 pass through the apparatus for aligning vouchers 12 to 18 again. This process can be repeated as many times as necessary until the voucher 12 to 18 is in the specified position.

A respective pressure element of pressure unit 278*a*, 278*b* can be moved through the recesses 264*a*, 264*b* to transport plane 10. With the aid of pressure unit 278*a*, 278*b*, a pressure force can be applied to a voucher 12 to 18 perpendicular to transport plane 10 if said voucher is in the pressure area of the pressure unit 278*a*, 278*b*. When only one pressure unit 287*a* or 278*b* is activated, voucher 12 to 18 is braked or stopped in the partial plane of transport plane 10 in which pressure element 278*a* or 278*b* applies the pressure force perpendicular to transport direction 10, while voucher 12 to 18 is transported, at least in the other partial plane of transport plane 10, further in transportation direction P1 at essentially unchanged speed. As a result, the voucher is caused to rotate about the point at which pressure force is exerted by pressure unit 278*a*, 278*b*. In this way, a possibly existing angular displacement of voucher 12 to 18 can be eliminated, or at least reduced. The pressure area, or contact area, of the pressure units 278*a*, 278*b*, with which the respective pressure unit 278*a*, 278*b* contacts the surface of a voucher 12 to 18, preferably has a surface with high frictional adhesion. Specifically, the contact area of the pressure elements of pressure units 278*a*, 278*b* has an element made of rubber or a coating of rubber. Furthermore, it is advantageous if the end of the pressure units 278*a*, 278*b* aligned in the direction of transport plane 10 has a hemispherical shape so that the pressure force is introduced in a punctiform manner, or over a small area, into the voucher. It is furthermore advantageous if cover plate 146 of lower part 22, at the locations where the pressure elements 278*a*, 278*b* press against cover plate 146 of lower part 22, has hemispherical elevations towards transport plane 10 as counter-pressure elements. A pressure force to slow or to stop voucher 12 to 18 can thereby be introduced into voucher 12 to 18 so that a rotation of voucher 12 to 18 around the contact point using the pressure element 278*a*, 278*b* and the counter-pressure element when only one pressure unit 278*a*, 278*b* is activated is not, or only slightly, prevented. With the simultaneous activation of pressure units 278*a*, 278*b*, the distances Y between two vouchers 12 to 18 being transported one after the other along transport path 10 can be changed.

Pressure rollers 224 to 252 as well as pressure units 278*a*, 278*b* can be moved with the aid of drive units for moving pressure rollers 224 to 252, or pressure units 278*a*, 278*b*, to transport plane 10. In this process, pressure rollers 224 to 252, depending on the activation of the respective drive unit, are moved towards drive rollers 24 to 52 and away from drive rollers 24 to 52 again. If one of the pressure rollers 224 to 252 has been moved to the opposite roller 24 to 52, they touch the respective drive roller 24 to 52 and can thus apply a force perpendicular to transport plane 10 to a voucher 12 to 18 located between drive roller 24 and 52 and pressure roller 224 to 252. The drive units for moving pressure rollers 224 to 252 and pressure units 278*a*, 278*b* are described in more detail in the following Figures.

Because the non-driven pressure rollers 224 to 252, and not the driven drive rollers 124 to 152, are moved with the aid of drive units, a lower mass has to be moved. If drive rollers 124 to 152 were moved, greater masses would have to be moved because of the drive elements coupled to the drive rollers. This would result in a more sluggish mechanical system, and longer reaction times would be required. Furthermore, it would be considerably more complicated from a design standpoint to move drive rollers 124 to 152 in this way.

Figure 8:
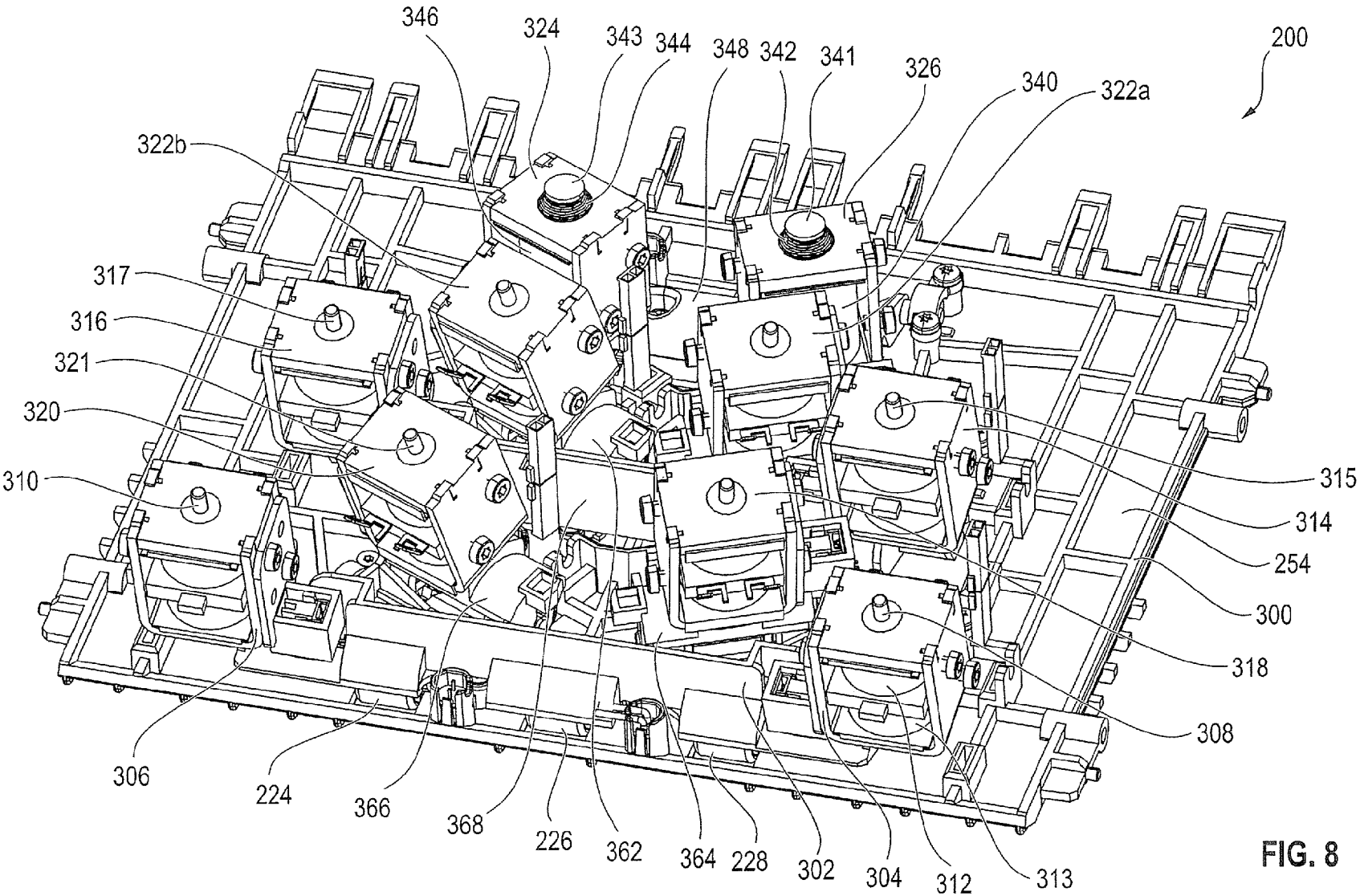
FIG. 8 shows a first schematic perspective representation of the upper part of the apparatus for aligning vouchers of FIG. 7, with a view of the top side of the upper part with reference to the installed position of the upper part looking in the transport direction of the vouchers.

FIG. 8 shows a schematic perspective representation of upper part 200 of the apparatus for aligning vouchers 12 to 18 from FIG. 7 with a view of the top side of upper part 200 and viewed in transport direction P1 of vouchers 12 to 18. Cover plate 254 of upper part 200 has several stiffening webs and attachment points for additional components of upper part 200 on the side facing away from the transport plane 10. An example of one of these webs is identified with the reference numeral 300.

Pressure rollers 224 to 228 are located in a retaining and guide element 302 and have a common axis of rotation. Pressure rollers 224 to 228 are carried in the retaining and guide element 302 free to rotate about the axis of rotation, wherein the axis of rotation has a fixed relative position to the retaining and guide element 302 and wherein the pressure rollers and the retaining and guide element 302 are not pivotable about an axis orthogonal to transport plane 10. Retaining element 302 is connected by pivot bearings to cover plate 254 of upper part 200.

The respective ends of retaining and guide element 302 are connected to an armature 308, 310 of a lift solenoid 304, 306. Lift solenoid 304 encompasses two coils 312, 313 and an armature 308. Armature 308 is connected to retaining and guide element 302 to move said element by a pivoting motion through the pivot bearings out of the outside of cover plate 254, or in the opposite direction further into cover plate 254. The conveying direction of pressure rollers 224 to 228 remains parallel to center axis 20. The two coils 312, 313 of lift solenoid 304 are connected alternately by a control unit to a voltage source to bring about a desired motion of armature 308, 310. Lift solenoids 304, 306 have at least one permanent magnet that is used to retain armature 308, 310 in an end position, preferably in the position in which pressure rollers 224 to 252 are not pressed against the opposite drive rollers by lift solenoids 304, 306. When current flows through one of the two coils 304, 306, armature 308 is moved along its lengthwise axis towards lower part 22, or conversely away from said lower part.

Alternatively, a lift solenoid 304, 306 can also be used that has only one coil 312, 313. When current flows through this coil, the armature of the lift solenoid and the pressure roller coupled to the armature is moved towards the drive roller opposite. In this case, the lift solenoid has a return spring that, when current flow through the coil is interrupted, moves the armature back to its starting position in which the pressure roller coupled to the armature does not make contact with the drive roller opposite.

The construction and operation of lift solenoid 306 are identical to the construction and operation of lift solenoid 304. When armatures 308, 310 of lift solenoids 304, 306 are raised, the retaining and locating element 302 is pivoted upwards so that pressure rollers 224 to 228 are moved away from transport plane 10 and drive rollers 24 to 28. In this way, pressure rollers 224 to 228 can no longer exert any pressure force on a voucher 12 to 18 being transported on transport plane 10 in transportation direction P1 or on driver rollers 24 to 28 opposite.

Additional lift solenoids shown 314 to 322*b* are constructed identically to lift solenoids 304, 306. Lift solenoid 314 is connected to a locating unit (not shown) in which pressure roller 232 is carried free to rotate about its axis of rotation. Pressure roller 232, together with the locating unit, can be moved orthogonally or, alternatively, obliquely to transport plane 10 by lift solenoid 314. Armature 317 of lift solenoid 316 is similarly connected to a locating unit (not shown) in which pressure roller 230 is carried free to rotate. Pressure roller 230, together with the locating unit, can thus be moved orthogonally or, alternatively, obliquely to transport plane 10 by lift solenoid 316.

Upper part 200 further comprises a locating unit 366 in which pressure rollers 238 and 240 are respectively carried free to rotate. Locating unit 366 is connected to cover plate 254 of upper part 200 so that it can be moved towards transport plane 10 and away from said plane. Locating unit 366 is furthermore connected to armature 321 of a lift solenoid 320. When armature 321 is moved away from transport plane 10 by suitable activation of lift solenoid 320, locating unit 366 is also moved away from transport plane 10. As a result, pressure rollers 238 and 240 are moved away from transport plane 10 and lifted by pressure rollers 38, 40 located opposite. In the same way, pressure rollers 242 to 252 are coupled to lift solenoids 318 to 322. Pressure rollers 242 to 252 can thus also be moved, i.e. lifted or lowered, orthogonally or obliquely to transport plane 10.

Armatures 341, 343 of lift solenoids 324, 326 are rigidly connected to the pressure elements of the pressure units 278*a*, 278*b* or, alternatively, constitute these pressure elements. The pressure elements of pressure units 278*a*, 278*b* can be moved perpendicular to transport plane 10 by lift solenoids 324, 326. The construction of lift solenoids 324, 326 differs from the construction of lift solenoids 304 to 322 in that lift solenoids 324, 326 respectively have only one coil 340, 346 to move the pressure elements out of cover plate 254 to transport plane 10 and in the opposite direction. A movement of the pressure elements of pressure units 278*a*, 278*b* in the opposite direction is generated by the spring force of respective return spring 342, 344, which effects a movement of armatures 341, 343 opposite to a movement induced by coils 340, 346 once coil 340, 346 is deenergized. Return springs 342, 344 are located on the top side of lift solenoids 324, 326. As an alternative, it is possible to use lift solenoids that have a similar construction to lift solenoids 304 to 322 in place of lift solenoids 324 and 326.

Figure 9:
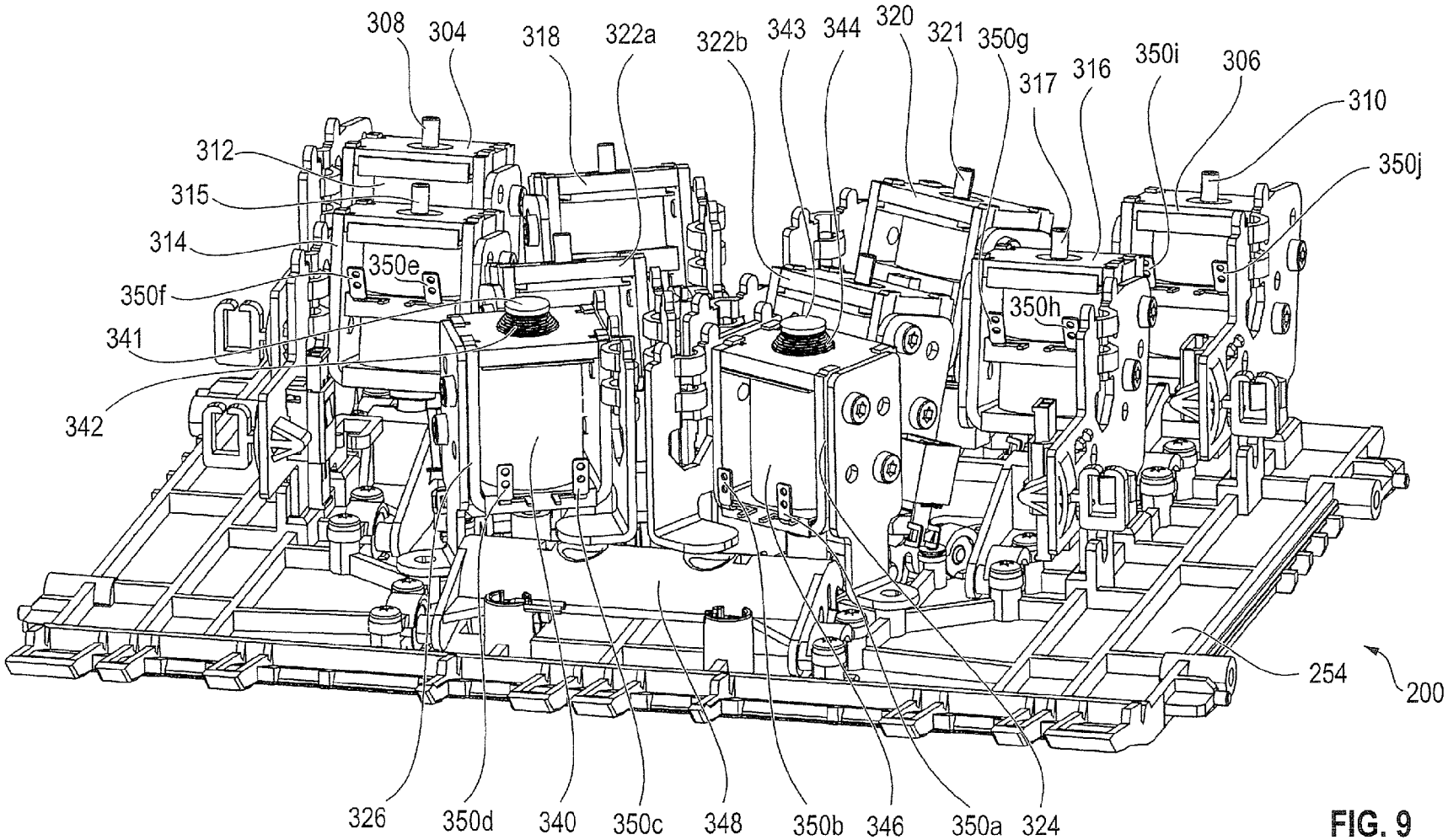
FIG. 9 shows a further schematic perspective representation of the upper part of FIGS. 7 and 8 looking in the opposite direction to the transport direction of the vouchers.

FIG. 9 shows a schematic perspective representation of upper part 200 of the apparatus for aligning vouchers 12 to 18 from FIGS. 7 to 8 looking down on the top side of upper part 200 and viewed in the direction opposite to transport direction P1. A further retaining and locating element 348 is connected pivotably to cover plate 254 of upper part 200. Pressure rollers 234, 236, which are not visible, are carried in retaining and locating element 348 free to rotate, fixed in place and not pivotable about an axis orthogonal to transport plane 10. Retaining and locating element 348 is connected to the armatures of two lift solenoids not shown. With the aid of said lift solenoids, the retaining and guide element 348 can be moved towards guide rollers 34, 36 lying opposite and away from said guide rollers so that pressure rollers 234, 236 can be moved essentially orthogonally, or alternatively obliquely, to transport plane 10.

Figure 10:
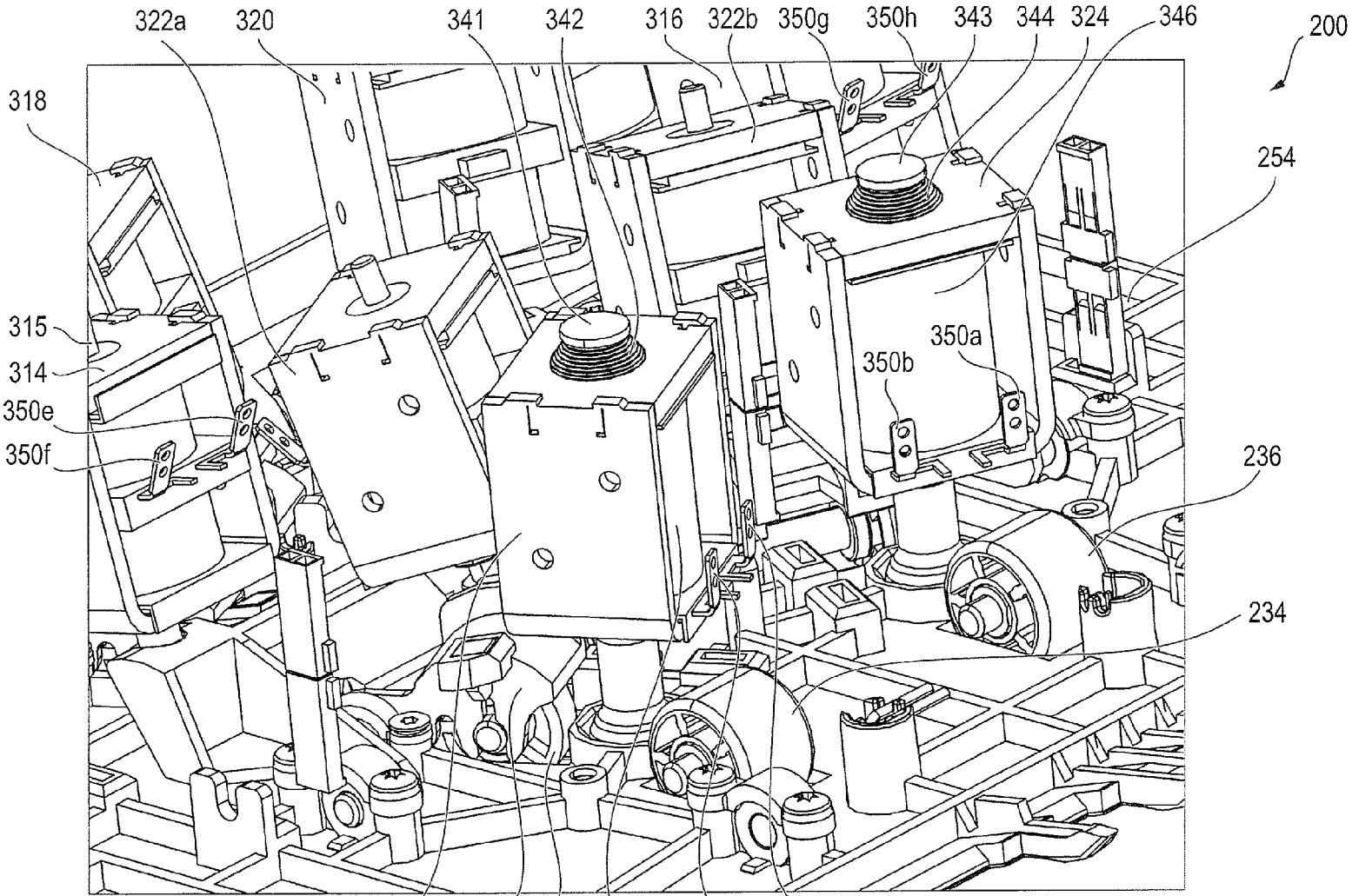
FIG. 10 shows a section of a schematic perspective representation of the upper part of FIGS. 7 and 8 with a view of the top side of the upper part looking in the opposite direction to the transport direction of the vouchers.

Several electrical contact elements 350*a* to 350*j* for flat-pin plugs are further shown in FIG. 10, with which connecting leads not shown can be attached to provide power to the respective coils of the lift solenoids.

FIG. 10 shows a section of upper part 200 of the apparatus for aligning vouchers 12 to 18 from FIGS. 7 to 9 looking down on the top side of upper part 200 and viewed in the direction opposite to transport direction P1 of vouchers 12 to 18. The retaining and guide element 348 has been removed in the representation from FIG. 10 so that pressure rollers 234, 236 are visible.

Figure 11:
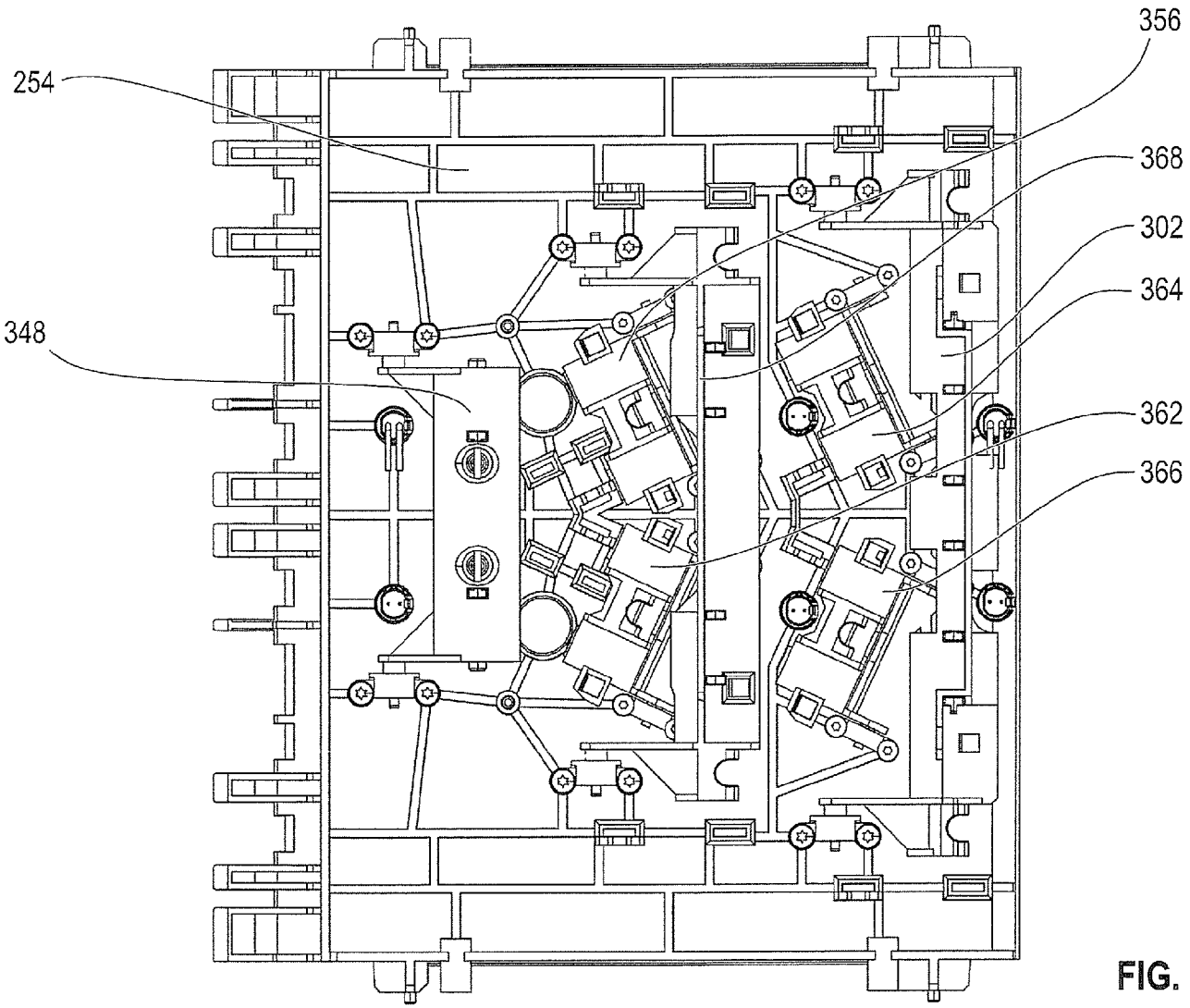
FIG. 11 shows a plan view of the upper part of the apparatus for aligning vouchers of FIGS. 7 to 10.

FIG. 11 shows a plan view of upper part 200 of the apparatus for aligning vouchers 12 to 18. In addition to retaining and guide elements 302 and 348, upper part 200 comprises still another retaining and guide element 368. Pressure rollers 230 and 232 are carried free to rotate in retaining and guide element 368 and not pivotable about an axis orthogonal to transport plane 10. Retaining element 368 can be pivoted away from transport plane 10 or towards transport plane 10 via lift solenoids 314 and 316 not shown.

Upper part 200 further comprises two additional locating units 362, 364. Pressure rollers 242 and 244 are carried free to rotate in locating unit 364 and not pivotable about an axis orthogonal to transport plane 10. Pressure rollers 250 and 252 are carried free to rotate in locating unit 362 and not pivotable about an axis orthogonal to transport plane 10. Locating unit 364 can be pivoted away from transport plane 10 or towards transport plane 10 via lift solenoid 321 not shown in FIG. 11. Locating unit 362 can be pivoted away from transport plane 10 or towards transport plane 10 via lift solenoid 322*b* not shown in FIG. 11.

Figure 12:
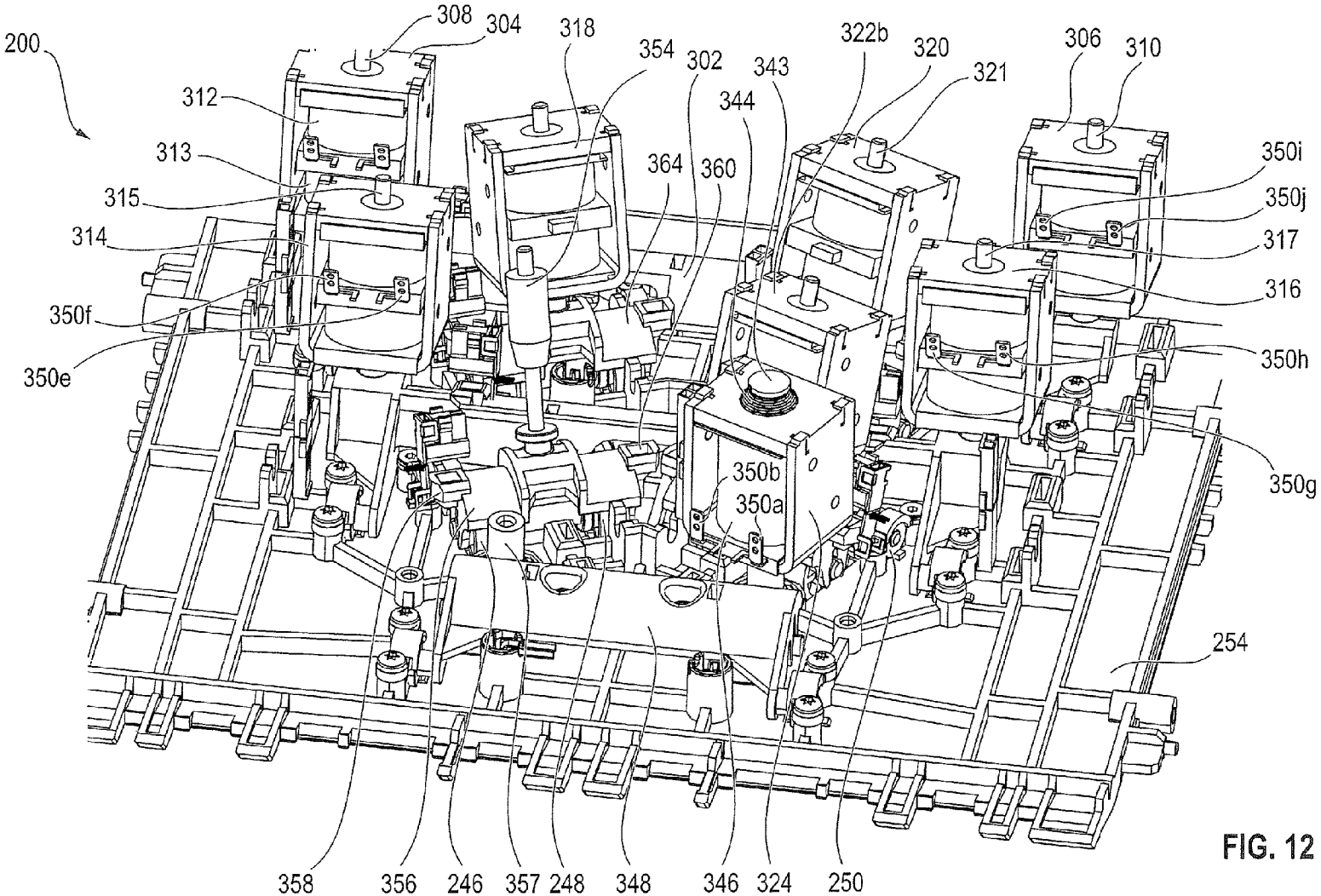
FIG. 12 shows a schematic perspective representation of the upper part of the apparatus for aligning vouchers of FIGS. 7 to 11 with a view of the top side of the upper part and viewed in the opposite direction to the transport direction of the vouchers.

FIG. 12 shows a schematic perspective representation of upper part 200 of the apparatus for aligning vouchers 12 to 18 from FIGS. 7 to 11 looking onto the top side of upper part 200 and viewed opposite to transport direction P1 of vouchers 12 to 18. Only the armature of lift solenoid 322*b* is shown in FIG. 12 so that locating unit 356 coupled to the armature for locating pressure rollers 246, 248 is visible. Further, the entire lift solenoid 326, including armature 352, is not shown so that in FIG. 12 only pressure element 357 that is rigidly connected to armature 354 of lift solenoid 326 in the operational state can be seen. The pivoting motion of locating unit 356 is guided by guide elements 358 and 360. Guide elements 358 and 360 in turn are rigidly connected to cover plate 254 of upper part 200. When armature 354 of lift solenoid 326 is moved upward with suitable activation of lift solenoid 326, locating unit 356 together with armature 354 is similarly moved upward. Pressure rollers 246 and 248 are thereby moved upwards, together with locating unit 356, away from transport plane 10. At least one guide element is provided for the remaining locating units to guide the movement of the respective locating unit.

Figure 13:
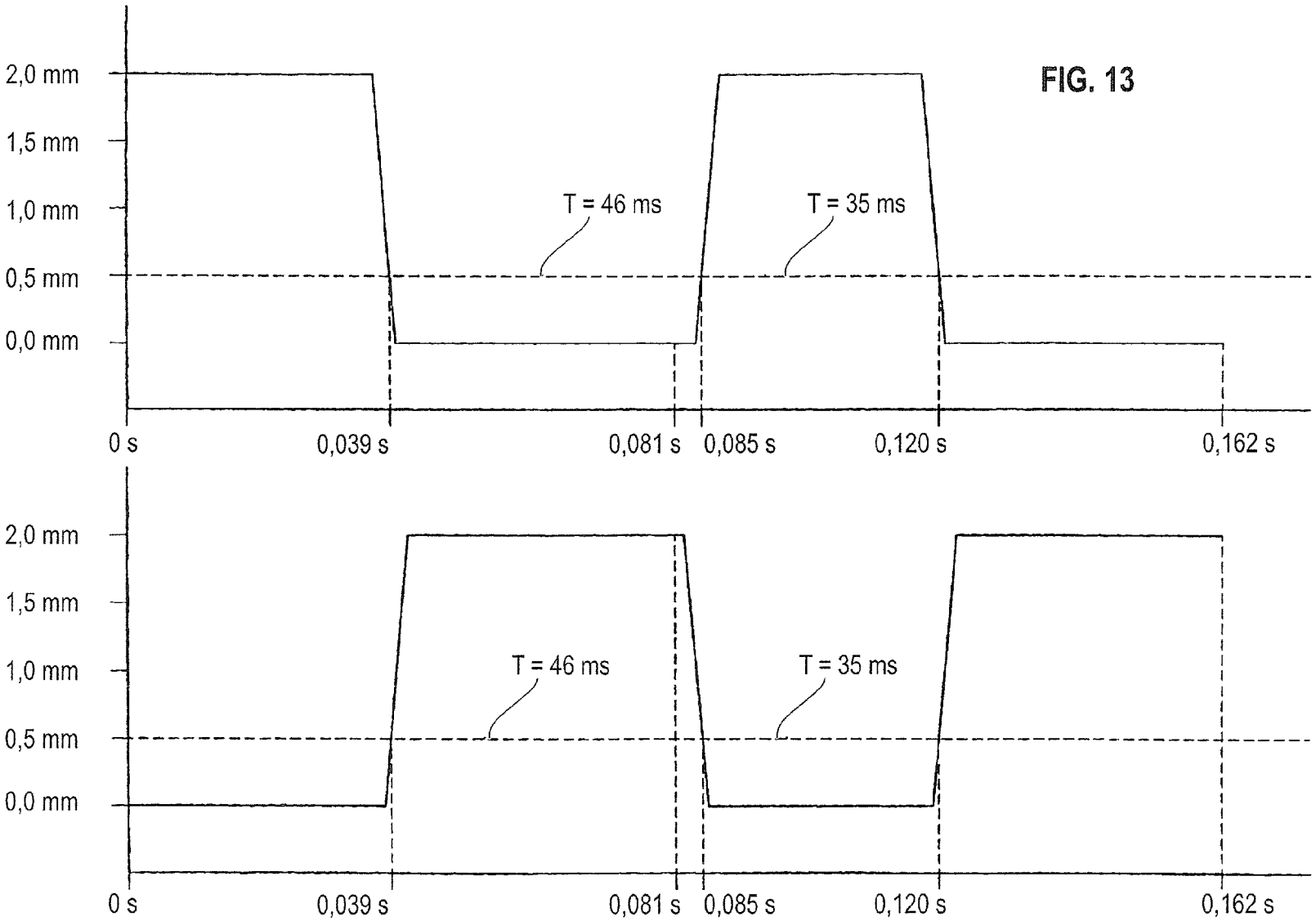
FIG. 13 shows a chart of the activation of pressure rollers for generating or correcting a lateral displacement of the voucher of 30 mm.

FIG. 13 shows a chart with the plot of the movement of pressure rollers 224 to 252 effected by the lift solenoids for a lateral displacement of 30 mm that is to be generated or corrected. The lateral displacement has already been identified before vouchers 12 to 18 were brought in with the help of a sensor unit located upstream from the apparatus for aligning vouchers, preferably with the help of the unit for genuineness verification already mentioned, and transmitted to a control unit. The necessary activation of the lift solenoids is determined with the help of the control unit.

Drive rollers 24 to 52 are permanently driven at the same speed. In the pressure position, a pressure roller 224 to 252 is pressed against the drive roller 24 to 52 opposite with a force perpendicular to transport plane 10. If a voucher 12 to 18 is located between pressure roller 224 to 252 in the pressure position and drive roller 24 to 52 lying opposite, said voucher is pressed by pressure roller 224 to 252 against drive roller 24 to 52. If pressure roller 224 to 252 is in a raised position in which it does not touch drive roller 24 to 52 lying opposite, no force is applied to a voucher 12 to 18 that is positioned in transport plane 10 at the location between the respective pressure roller 224 to 252 and the respective drive roller 24 to 52 opposite.

The roller pairs formed by pressure rollers 224 to 252 and drive rollers 24 to 52 can be classified in two groups. The roller pairs formed by pressure rollers 224 to 252 and drive rollers 24 to 36 serve to transport vouchers 12 to 18 straight ahead. These roller pairs for transporting vouchers 12 to 18 function exclusively to transport vouchers 12 to 18 straight ahead in transport direction P1. The roller pairs formed by pressure rollers 238 to 252 and driver rollers 38 to 52 are also described as roller pairs for laterally displacing vouchers 12 to 18. The roller pairs for laterally displacing vouchers 12 to 18 have an angle different from zero to an orthogonal to center axis 20 of transport plane 20. The roller pairs for laterally displacing vouchers 12 to 18, apply a force obliquely to transport direction P1 as long as the respective pressure roller 238 to 252 is in the pressure position. The result is that vouchers 12 to 18 are transported obliquely to transport direction P1 so that any lateral displacement present can be corrected. The longer a pressure roller 238 to 252 presses on the respective drive roller 38 to 52, that is, the longer a pressure roller 238 to 252 is in the pressure position, the further voucher 12 to 18 is moved by the pair of rollers in the direction of center axis 20 of transport plane 10. When voucher 12 to 18 makes contact with the roller pairs for lateral displacement, voucher 12 to 18 is not engaged with, or not in contact with, the roller pairs for being transported straight ahead.

If the pressure elements of pressure units 278*a*, 278*b* are in a lower position in which the contact areas of the pressure elements press against cover plate 146 of lower part 22, a force perpendicular to transport plane 10 is applied to a voucher 12 to 18 positioned at the location of pressure units 278*a*, 278*b* in transport plane 10. As a result, said voucher is sharply braked or stopped completely at the location of pressure unit 278*a*, 278*b* and executes a rotary movement around the contact point of voucher 12 to 18 with the contact area of the pressure element. The longer the pressure element is in the lower position, that is, the longer the pressure element of pressure unit 278*a*, 278*b* is pressed onto voucher 12 to 18, the further voucher 12 to 18 is rotated since it is simultaneously being driven onward by the roller pairs for straight ahead transport. In this way, a possibly present angular displacement of a voucher 12 to 18 can be corrected in a simple manner.

Using the information on angular or lateral displacement provided for a voucher 12 to 18 as a point of departure, the evaluation unit determines when and how long which pressure roller 224 to 252, or when and how long which pressure unit 278*a*, 278*b*, has to be brought into the pressure position in order to correct, i.e. to reduce or to eliminate, the possibly present angular and/or lateral displacement.

FIG. 13 shows the movement of pressure rollers 224 to 236 of the roller pairs for transporting vouchers 12 to 18 straight ahead, and of pressure rollers 238 to 252 of the roller pairs for correcting the lateral displacement of vouchers 12 to 18 effected by the activation of the lift solenoids. Respective time is indicated on the x-axis. The travel for the movement of pressure rollers 224 to 252 is indicated on the y-axis. At 0.0 mm, pressure rollers 224 to 252 are in the maximum pressure position, i.e. pressure rollers 224 to 252 have been moved furthest out of cover plate 254. Transport plane 10 is at 0.5 mm. Further movement to 0.0 mm is prevented by drive rollers 24 to 52 located opposite pressure rollers 224 to 252, but a corresponding pressure force is generated. If a pressure roller 224 to 252 is consequently positioned at the level 0.5 mm, it touches the corresponding drive roller 24 to 52. The upper part of the chart in FIG. 13 indicates the chronological course of the heights of pressure rollers 238 to 252 of the roller pairs for correcting the lateral displacement of vouchers 12 to 18. The lower part of the chart in FIG. 13 indicates the chronological course of the height of pressure rollers 24 to 28; or 30 to 32, of the roller pairs for transporting vouchers 12 to 18 straight ahead. Transport straight ahead is also described as primary transport. During the first 0.039 seconds, pressure rollers 24 to 38 of the roller pairs for the straight ahead transport of vouchers 12 to 18 are in the pressure position, and pressure rollers 238 to 252 of the roller pairs for correcting a lateral displacement of vouchers 12 to 18 are in the upper position. During this time period, vouchers 12 to 18 are transported solely in transport direction P1. In a second time period, which starts at 0.039 seconds and ends at 0.085 seconds, pressure rollers 224 to 236 of all roller pairs for transporting vouchers 12 to 18 straight ahead are in the upper, raised position, whereas pressure rollers 238, 240, or 242, 244, of the roller pairs for correcting the lateral displacement of vouchers 12 to 18 are in the pressure position. During this time period, vouchers 12 to 18 are moved perpendicular to transport direction P1. In this time period, the roller pairs that are formed by pressure rollers 238 and 240, or 242 and 244, drive rollers 38 and 40, or 42 and 44, apply a force to voucher 12 to 18 and shift voucher 12 to 18 laterally. Depending on the direction of displacement needed, pressure rollers 238 and 240 or pressure rollers 242 and 244 are activated.

During a third time period, which begins at time 0.085 seconds and ends at time 0.120 seconds, pressure rollers 230 to 232 of the roller pairs for transporting vouchers 12 to 18 straight ahead are in the pressure position, whereas the remaining pressure rollers 234 to 252 are in the raised position. During this third time period, vouchers 12 to 18 are transported solely in transport direction P1. To do this, the roller pairs made up of pressure rollers 230, 232 and drive rollers 30, 32 apply a force to vouchers 12 to 18.

In a fourth time period, which begins at 0.120 seconds and ends at 0.162 seconds, pressure rollers 224 to 236 of the roller pairs for straight ahead transportation of vouchers 12 to 18 are not in the pressure position, while pressure rollers 246, 248, or 250, 252, are in the pressure position, depending on the required angular displacement of the roller pairs for eliminating or reducing a lateral displacement of vouchers 12 to 18. During this fourth time period, vouchers 12 to 18 are transported perpendicular or obliquely to transport direction P1. Vouchers 12 to 18 are contacted and transported during the fourth time period by the roller pairs made up of pressure rollers 246, 248, or 250, 252, and drive rollers 46, 48 or 50, 52.

A complementary plot of this type for the heights of pressure rollers 224 to 236 of the roller pairs for the straight ahead transport of vouchers 12 to 18 is advantageous since simultaneous contact of pressure rollers 224 to 236 and 236 to 252 is prevented. The forces imposed on vouchers 12 to 18 by simultaneous contact are avoided. Such forces could result in damage to vouchers 12 to 18.

Figure 14:
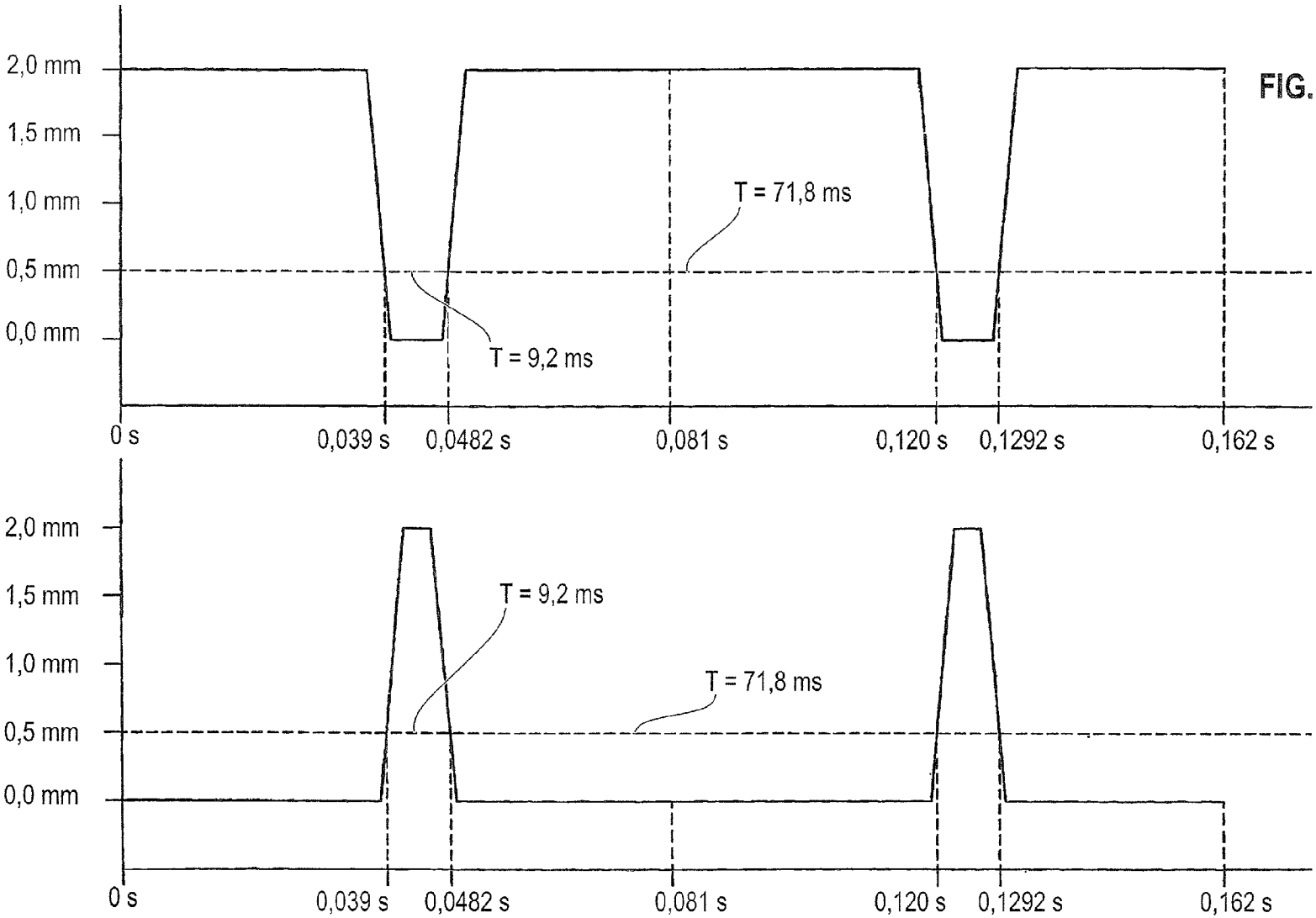
FIG. 14 shows a chart of the activation of the pressure rollers for generating or correcting a lateral displacement of the voucher of 6 mm.

FIG. 14 shows a chart for the actuation of pressure rollers 224 to 252 for a positional displacement of 6 mm of vouchers 12 to 18. Compared with FIG. 13, the time periods in which pressure rollers 238, 240, or 242, 244 and 248 or 250, 252 of the roller pairs for correcting lateral displacement of vouchers 12 to 18 in the pressure position are clearly shorter.

Figure 15:
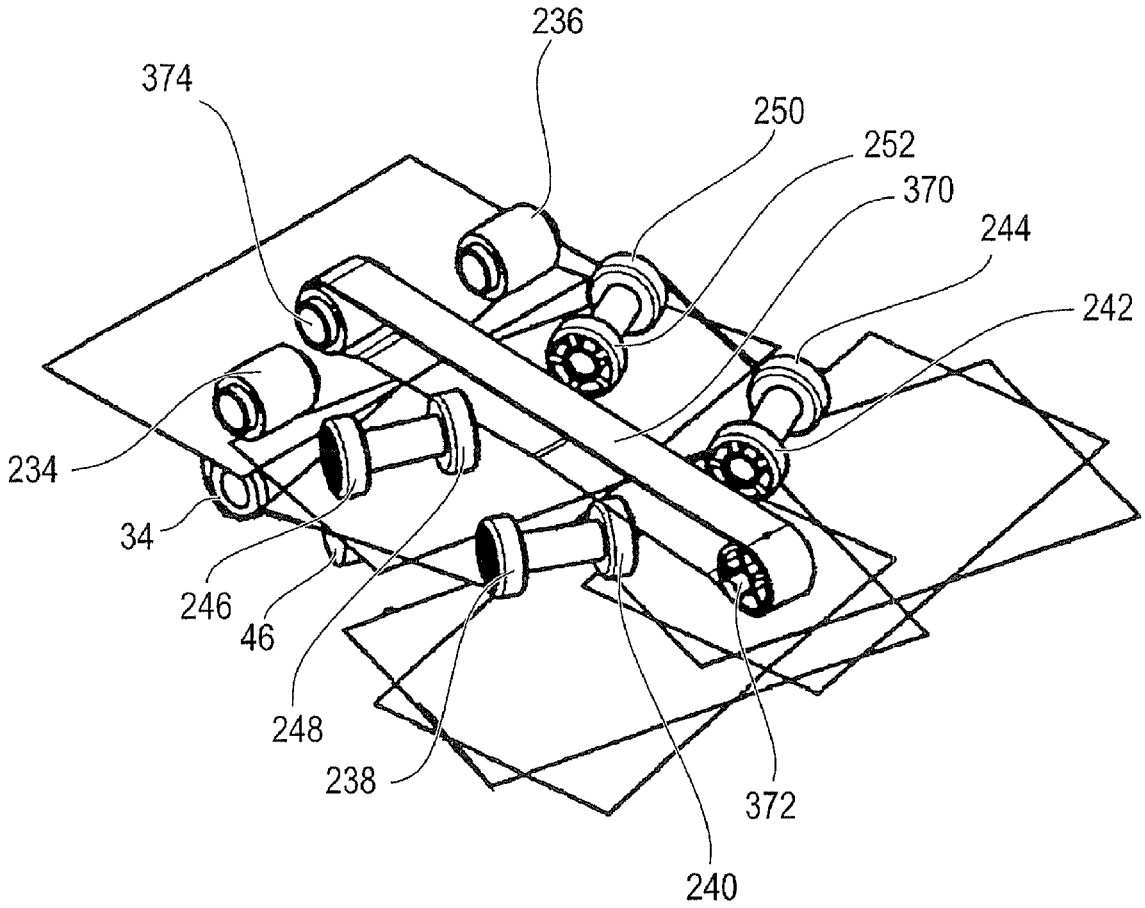
FIG. 15 shows a schematic representation of an apparatus for aligning vouchers having a pair of transport belts in accordance with a second embodiment of the invention.

FIG. 15 shows a schematic representation of an alternative construction for the apparatus for aligning vouchers 12 to 18 having a pair of transport belts. In this alternative construction, pressure rollers 224 to 232 have been replaced by a first transport belt 370 that is taken over two rollers 372 and 374. Similarly, drive rollers 24 to 32 are replaced by a second transport belt not shown. The first transport belt 370 and the second transport belt are described jointly as transport belt pair. The transport belt pair serves in the present embodiment solely to transport vouchers 12 to 18 straight ahead.

The first transport belt 370 can be moved by lift solenoids not shown to transport plane 10 or away from transport plane 10. The first transport belt 370 is not driven. On the other hand, the second transport belt is driven permanently. The second transport belt is preferably moved at the same circumferential speed as drive rollers 34 to 52. Drive rollers 34 to 52 and pressure rollers 234 to 252 are arranged exactly as in the embodiment from FIGS. 2 to 11 and have the same functions as in the embodiment from FIGS. 2 to 11.

The invention claimed is:

1. Apparatus for aligning at least one voucher, comprising:

first and second transport elements for transporting the voucher on a transport plane of a transport path;

at least one first rotating transport element is provided that generates a drive force acting on the voucher obliquely to a center axis lying on the transport plane of the transport path;

at least one second rotating transport element is provided that generates a drive force on the voucher acting parallel to the center axis of the transport path;

at least one first drive unit for selectively moving the first rotating transport element at least to the transport plane or away from the transport plane along a first pathway;

at least one second drive unit for selectively moving the second rotating transport element at least to the transport plane or away from the transport plane along a second pathway; and at least one pressure unit that applies a pressure force in a pressure position to the voucher perpendicular to the transport plane.

2. Apparatus of claim 1, wherein the conveyance direction created by the second rotating transport element for transporting the voucher runs parallel to center axis of the transport path, and wherein the conveyance direction for transporting the voucher generated by the first rotating transport element runs obliquely to the center axis and preferably intersects the center axis downstream in transport direction of the transport path.

3. Apparatus of claim 1, wherein the first transport element and/or the second transport element comprise at least one roller pair, whereby the roller pairs comprise a pressure roller and a drive roller, and whereby the pressure roller of at least one roller pair can be moved perpendicularly to the transport plane with the aid of the drive unit.

4. Apparatus of claim 1, wherein at least two, preferably eight, roller pairs are provided for correcting a lateral displacement of the voucher.

5. Apparatus of claim 3, wherein two roller pairs acting respectively as first transport elements for correction are disposed mirror-symmetrical to a center plane running orthogonally to the transport plane through the center axis of the transport path.

6. Apparatus of claim 3, wherein the conveyance directions of the roller pairs for correcting a lateral displacement of the voucher which are disposed on a first side of a center plane running orthogonally to the transport plane through the center axis of the transport path, have the same first angle to an orthogonal to the center axis of the transport path lying in the transport plane, and wherein the conveyance directions of the roller pairs for correcting a lateral displacement of the voucher that are disposed on the opposite second side of the center plane respectively have the same second angle to an orthogonal to the center axis lying in the transport plane, wherein the first and second angle are the same amount and have an opposite sign.

7. Apparatus of claim 6, wherein the first angle has a value in the range from +20° to +35°, preferably +25°, and wherein the second angle has a value in the range from −20° and −35°, preferably −25°.

8. Apparatus of claim 3, wherein the at least one first drive unit and/or the at least one second drive unit moves at least one pressure roller optionally in the direction of the drive roller lying opposite the pressure roller and in the opposite direction.

9. Apparatus of claim 3, wherein the axes of rotation of the drive rollers are fixed in place, and wherein the drive unit shifts the axes of rotation of the pressure rollers at a movement of the pressure rollers at least to the transport plane.

10. Apparatus of claim 1, wherein the second transport element comprises at least one pair of transport belts.

11. Apparatus of claim 1, wherein at least two pressure units are provided that have the same lateral distance to a center plane running orthogonally to the transport plane through the center axis of the transport path, whereby the directions of force of the pressure forces that can be applied through the pressure units to the voucher are parallel to each other.

12. Apparatus of claim 1, wherein a first delimiting element delimiting a transport area of the transport path with a first contact area facing the transport area and/or a second delimiting element delimiting the transport area of the transport path with a second contact area facing the transport area are provided, where the contact areas are disposed oppositely and delimit the transport area, and where at least one contact area has several convex embossments projecting from the contact area.

13. Apparatus of claim 12, wherein the first and/or second contact area viewed in transport direction has a recess behind at least one drive and/or pressure roller.

14. Apparatus of claim 1, wherein the control unit, using the lateral displacement ascertained, determines for which time period at least one of the pressure rollers is pressed against the drive roller lying opposite the pressure roller during transport of the voucher along the transport path, where different pressure periods can be determined with several pressure rollers, and wherein the control unit using the angular displacement ascertained determines for which time period at least one of the pressure units applies pressure force to this voucher during transport of the voucher along the transport path, where different pressure periods can be determined using several pressure units.

15. Apparatus of claim 1, wherein the end of the pressure unit aligned in the direction of the transport plane has a hemispherical shape.

16. Apparatus of claim 1, wherein a contact area of the pressure elements of the pressure units that contacts the vouchers has an element produced from rubber or a coating of rubber.

17. Apparatus for aligning at least one voucher, comprising first and second transport elements for transporting the voucher on a transport plane of a transport path, wherein at least one first rotating transport element is provided that generates a drive force acting on the voucher obliquely to a center axis lying on the transport plane of the transport path, wherein at least one second rotating transport element is provided that generates a drive force on the voucher acting parallel to the center axis of the transport path, having at least one first drive unit for moving the first rotating transport element at least to the transport plane, having at least one second drive unit for selectively moving the second rotating transport element at least to the transport plane, and having at least one pressure unit that applies a pressure force in a pressure position to the voucher perpendicular to the transport plane;

wherein the first transport element and/or the second transport element comprise at least one roller pair, whereby the roller pairs comprise a pressure roller and a drive roller, and whereby the pressure roller of at least one roller pair can be moved perpendicularly to the transport plane with the aid of the drive unit.

18. An apparatus for aligning a voucher on a transport plane of a transport path, the apparatus comprising:

a drive assembly;

a pressure assembly opposite to the drive assembly, the drive assembly and the pressure assembly define the transport plane and the transport path therebetween;

a plurality of rotatable drive elements included in the drive assembly that are configured to generate a drive force acting on the voucher oblique to a center axis of the transport plane of the transport path;

a plurality of rotatable pressure elements included in the pressure assembly and aligned with the rotatable drive elements, the rotatable pressure elements are configured to apply pressure to the rotatable drive elements and be rotated by the rotatable drive elements;

a plurality of drive units configured to selectively move the rotatable pressure elements toward or away from the rotatable drive elements; and a control unit for operating the drive units to selectively move the rotatable pressure elements toward or away from the rotatable drive elements to thereby align the voucher on the transport plane when the voucher is between the rotatable pressure elements and the rotatable drive elements.

19. The apparatus of claim 18, wherein the rotatable drive elements are mounted at a fixed position with respect to the transport plane.

20. The apparatus of claim 18, wherein the plurality of rotatable drive elements includes rotatable drive elements that are configured to generate a drive force acting on the voucher parallel to the center axis of the transport plane of the transport path.

* * * * *